US009527285B2

(12) United States Patent
Arae et al.

(10) Patent No.: US 9,527,285 B2
(45) Date of Patent: Dec. 27, 2016

(54) NOZZLE PLATE, LIQUID DROPLET DISCHARGE HEAD, AND LIQUID DROPLET DISCHARGE APPARATUS

(71) Applicants: Sadanori Arae, Kanagawa (JP); Naoyuki Ueda, Kanagawa (JP); Yuki Nakamura, Tokyo (JP); Yukiko Abe, Kanagawa (JP); Shinji Matsumoto, Kanagawa (JP); Yuji Sone, Kanagawa (JP); Ryoichi Saotome, Kanagawa (JP); Minehide Kusayanagi, Kanagawa (JP)

(72) Inventors: Sadanori Arae, Kanagawa (JP); Naoyuki Ueda, Kanagawa (JP); Yuki Nakamura, Tokyo (JP); Yukiko Abe, Kanagawa (JP); Shinji Matsumoto, Kanagawa (JP); Yuji Sone, Kanagawa (JP); Ryoichi Saotome, Kanagawa (JP); Minehide Kusayanagi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/081,307

(22) Filed: Mar. 25, 2016

(65) Prior Publication Data

US 2016/0279939 A1 Sep. 29, 2016

(30) Foreign Application Priority Data

Mar. 27, 2015 (JP) ..... 2015-065699

(51) Int. Cl.
*B41J 2/14* (2006.01)

(52) U.S. Cl.
CPC ..... *B41J 2/1433* (2013.01); *B41J 2002/14491* (2013.01)

(58) Field of Classification Search
CPC .. B41J 2/1433; B41J 2/162; B41J 2002/14475
See application file for complete search history.

(56) References Cited

U.S. PATENT DOCUMENTS

| | | | | |
|---|---|---|---|---|
| 6,676,244 | B2 * | 1/2004 | Kwon | B41J 2/1404 347/47 |
| 2011/0037813 | A1 * | 2/2011 | Nakatani | B41J 2/14233 347/70 |
| 2013/0222481 | A1 * | 8/2013 | Yokoyama | B41J 2/14201 347/47 |
| 2015/0158300 | A1 | 6/2015 | Ueda et al. | |

FOREIGN PATENT DOCUMENTS

| | | |
|---|---|---|
| JP | 2007-320063 | 12/2007 |
| JP | 2010-100018 | 5/2010 |
| JP | 2014-028351 | 2/2014 |

* cited by examiner

*Primary Examiner* — Kristal Feggins
(74) *Attorney, Agent, or Firm* — Cooper & Dunham LLP

(57) ABSTRACT

A nozzle plate for a liquid droplet discharge head to discharge a charged liquid droplet, includes a discharge port disposed on a nozzle face; a discharge chamber filled with liquid to be discharged from the discharge port; a nozzle hole extending from the discharge port in a thickness direction of the nozzle plate and communicating with the discharge chamber; a first electrode disposed at either the discharge chamber or the nozzle hole and contacting part of the liquid droplet; and a second electrode disposed on the nozzle face and neither connecting to the first electrode nor contacting the liquid droplet.

18 Claims, 18 Drawing Sheets

NOZZLE PLATE, LIQUID DROPLET DISCHARGE HEAD, AND LIQUID DROPLET DISCHARGE APPARATUS

CROSS-REFERENCE TO RELATED APPLICATION

The present application claims priority pursuant to 35 U.S.C. §119(a) from Japanese patent application number 2015-065699, filed on Mar. 27, 2015, the entire disclosure of which is incorporated by reference herein.

BACKGROUND

Technical Field

The present invention relates to a nozzle plate, liquid droplet discharge head, and liquid droplet discharge apparatus.

Background Art

A display or a semiconductor integrated circuit includes a substrate and a plurality of patterned films of electronic materials laminated on the substrate. In the background art, the photolithographic method is used for high definition patterning, and recently, the patterning process has been implemented by a printing process in the closely watched field of printed electronics.

In printed electronics, several discrete printing processes are used, including screen printing, gravure printing, and micro-contact printing. An inkjet method is one of those processes.

In the inkjet method, an inkjet recording apparatus including an inkjet head to discharge liquid droplets of ink, for example, is used. The inkjet head includes a nozzle, from which liquid droplets are discharged, impacted onto a printing object, and printing is performed.

A typical inkjet head includes a nozzle face, discharge ports disposed on the nozzle face, nozzle holes as through-holes and spaces communicating with the nozzle holes in a depth direction, and a nozzle plate to form an ink liquid chamber communicating with each nozzle hole.

The inkjet head is configured to selectively discharge liquid droplets from the discharge port by applying force from a driving means to an ink meniscus formed at the discharge port. As driving means for the inkjet head, there are an electrostatic aspiration type, a piezoelectric type using a piezoelectric element, and a thermal type employing a thermal element.

In printed electronics, a high resolution of from submicrons to 10 μm is required to print circuit wiring of the electronic device, so that the application of the inkjet method of the electrostatic absorption type capable of discharging ultrafine liquid is being studied.

In the inkjet method of the electrostatic absorption type, a liquid droplet is electrically charged and then discharged onto a print object by electrostatic induction. As a result, when the print object is an insulating material, due to application of voltage from the drive electrode that charges the liquid droplet, electrical charge is accumulated on the surface of the print object due to aerial discharge from a tip end of the nozzle or from the nozzle plate, and the surface potential increases, destabilizing the potential difference between the nozzle plate and the print object and resulting in a discharging failure.

In one inkjet method of the electrostatic absorption type, a discharging member with a plurality of openings is disposed between the nozzle face of the inkjet nozzle and the surface of the print object. The ink liquid droplet discharged from the nozzle is contacted to the discharging member to be permeated by the discharging member, to be impacted to the print object.

In another inkjet method, an X-ray generator is disposed, and the print object is neutralized by irradiation with X-rays. As a result, the discharged ink is not affected by the electrical charge of the print object and the ink is impacted at a desired position.

SUMMARY

In one embodiment of the disclosure, provided is an optimal nozzle plate for a liquid droplet discharge head to discharge a charged liquid droplet, includes a discharge port disposed on a nozzle face; a discharge chamber filled with liquid to be discharged from the discharge port; a nozzle hole extending from the discharge port in a thickness direction of the nozzle plate and communicating with the discharge chamber; a first electrode disposed at either the discharge chamber or the nozzle hole and contacting part of the liquid droplet; and a second electrode disposed on the nozzle face and neither connecting to the first electrode nor contacting the liquid droplet.

In another embodiment of the disclosure, provides is an optimal liquid droplet discharge head including a nozzle plate as described above and a channel, connecting to the nozzle plate, through which the liquid droplet is supplied.

In further another embodiment of the disclosure, provided is an optimal liquid droplet discharge apparatus to discharge a liquid droplet to a discharging target, including a liquid droplet discharge head as described above; a voltage applying device connecting to the first electrode; a stage to support the discharging target; and a shifting device to shift the liquid droplet discharge head and the stage relative to each other.

These and other features and advantages of the present invention will become apparent upon consideration of the following description of the preferred embodiments of the present invention when taken in conjunction with the accompanying drawings.

BRIEF DESCRIPTION OF THE DRAWINGS

FIGS. 10A and 10B illustrate an adhesion plate, in which FIG. 10A is a plan view and FIG. 10B is a cross-sectional view;

DETAILED DESCRIPTION

Hereinafter, preferred embodiments of the present invention will now be described in detail with reference to the accompanying drawings from FIG. 1 to FIG. 20.

Nozzle Plate

Figure 1:
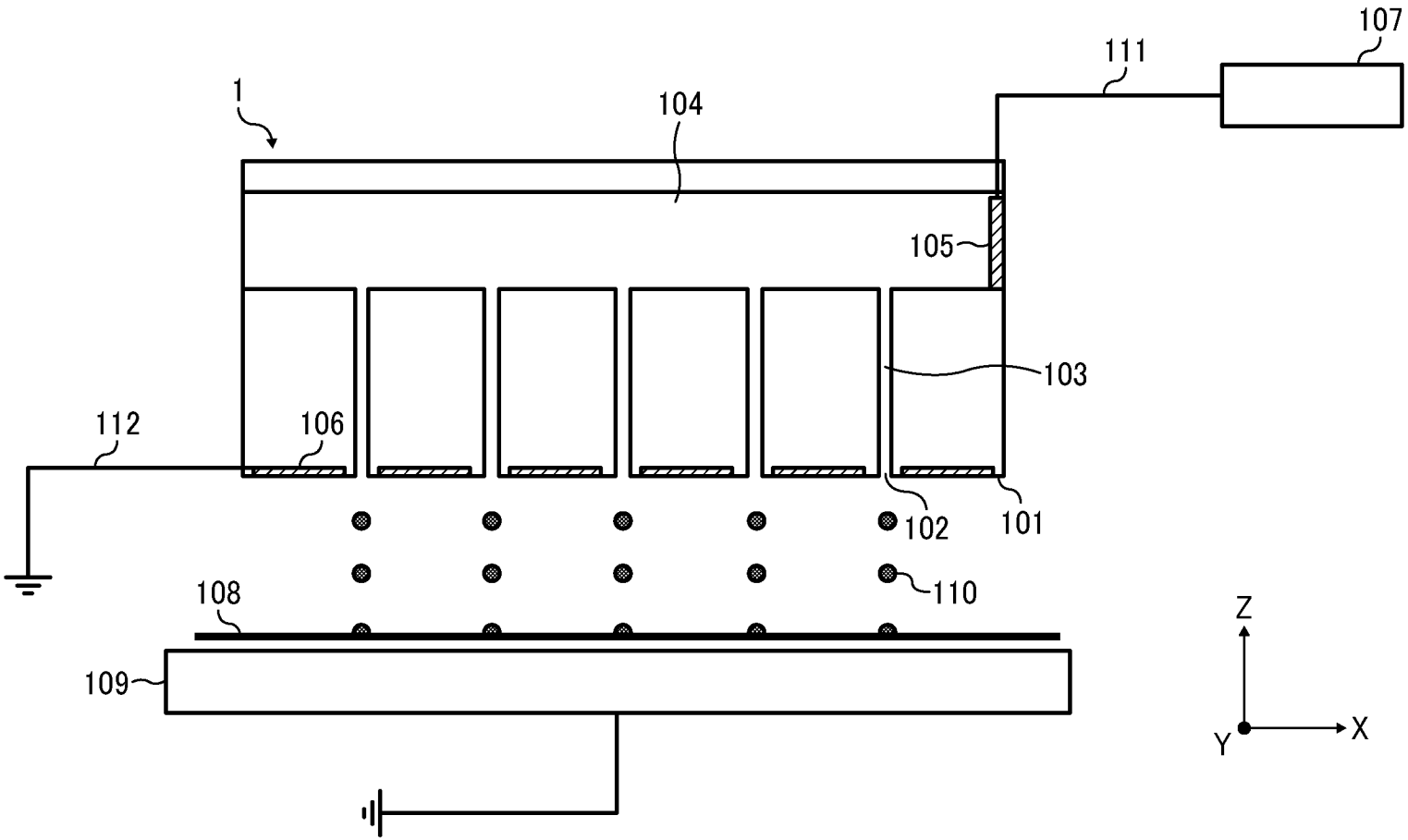
FIG. 1 illustrates a nozzle plate according to a first embodiment of the present invention.

FIG. 1 schematically illustrates an exemplary nozzle plate according to the first embodiment of the present invention and including a cross-sectional view of the nozzle plate with connection configuration of each electrode.

A nozzle plate 1 according to the present embodiment is employed for a liquid droplet discharge head to discharge a charged ink droplet 110 to a print object 108, and includes a plurality of discharge ports 102 disposed on a nozzle face 101 disposed opposite the print object 108; a discharge chamber 104 into which is supplied the liquid that forms the droplets discharged from the discharge port 102; a nozzle hole 103 formed in the nozzle plate from the discharge port 102 and communicating with the discharge chamber 104; a first electrode 105 disposed at either the discharge chamber 104 or the nozzle hole 103 and contacting part of the liquid; and a second electrode 106 disposed on the nozzle face 101 and not connecting to the first electrode 105 and not contacting the liquid droplet. The above reference numerals are applied to the same parts and components throughout the description of the embodiments.

As illustrated in FIG. 1, the nozzle plate 1 is employed for an inkjet head using the electrostatic absorption method in which the charged ink droplet 110 is discharged to the print object 108, and is a substrate in which the discharge port 102, the nozzle hole 103, and the discharge chamber 104 are formed. The nozzle plate 1 may include a substrate in which the discharge port 102 and the nozzle hole 103 are formed and another substrate in which the discharge chamber 104 is formed that are laminated together, and alternatively, may be formed of a single substrate. Further, in the present embodiment, an alignment direction of the nozzle or the discharge port 102 is denoted as X-direction, a direction perpendicular to X-direction on the nozzle face 101 is denoted as Y-direction, and the nozzle plate 1 perpendicular to X-, and Y-direction is denoted as Z-direction.

The nozzle plate 1 discharges the ink droplet 110 from the discharge port 102 toward the print object 108 placed on a stage 109 and impacts the ink droplet 110 on the print object 108. The stage 109 is electrically grounded.

A predetermined number of discharge ports 102 are formed on the nozzle face 101 opposite the print object 108, and the nozzle plate 1 further includes the discharge chamber 104 in which ink to be discharged to the print object 108 is filled. The nozzle hole 103 is formed from the discharge port 102 to the discharge chamber 104 in the depth direction of the nozzle plate 1 and the discharge port 102 communicates with the discharge chamber 104 via the nozzle hole 103, through which the ink filling the discharge chamber 104 can be discharged.

The first electrode 105 disposed on an inner wall of the discharge chamber 104 charges the ink inside the discharge chamber 104. The first electrode 105 connects to a high voltage pulse amplifier 107, which is a voltage applying device, via a wire 111, and is in contact with the ink inside the discharge chamber 104 to be electrically connected and serves as a voltage applying electrode to electrically charge the ink.

In the example of FIG. 1, the first electrode 105 is formed such that an electrode film is coated on one wall surface of the discharge chamber 104; however, the first electrode 105 may be disposed on at least a part of an inner wall of the discharge chamber 104, and is not limited to the example of FIG. 1.

The second electrodes 106 are formed such that the electrode film is coated on the nozzle face 101 of the nozzle plate 1. The second electrode 106 is formed on an area of the nozzle face 101 excluding an area in which the discharge port 102 is formed. That is, the second electrode 106 is formed in an area not contacting the ink droplet 110 when the ink droplet 110 is discharged from the discharge port 102. "The area not contacting the ink droplet 110" means an area where the second electrode 106 does not contact the ink droplet 110 when output from the discharge port 102 in a normal state. An abnormal state due to the clogging of the nozzle is excluded. In addition, the second electrode 106 is formed in an area not electrically connecting to the ink droplet 110 when the ink droplet 110 is discharged, and therefore, the second electrode 106 and the ink droplet 110 are not electrically connected.

Although the first electrode 105 is connected to the high voltage pulse amplifier 107, the second electrode 106 does not electrically connect to the first electrode 105, the high voltage pulse amplifier 107, and other voltage applying device such as pulse amplifier. As illustrated in FIG. 1, the second electrode 106 is preferably an earth electrode grounded via a wire 112.

The second electrode 106 serves as a neutralizing electrode to neutralize the ink droplet 110 impacted on the print object 108.

Specifically, in the nozzle plate 1 as illustrated in FIG. 1, even when the second electrode 106 is not employed, a surface potential of the print object 108 does not increase, because when the charged ink droplet 110 is discharged to the print object 108, the surface potential of the print object 108 moves via the print object 108 when the print object 108 is formed of conductive material.

On the other hand, when the print object 108 is an insulating material, the surface potential of the print object 108 does not displace to the print object 108, and the surface potential of the print object 108 increases. When the surface potential of the print object 108 increases, the potential difference between the nozzle plate 1 and the print object 108 becomes unstable, resulting in a discharging failure. Cumulative electrical charge on the surface of the print object 108 is not only caused from the charged ink droplet 110 after impacting, but is caused from aerial discharge from the discharge port 102 and the nozzle plate 1 itself due to application of voltage from the high voltage pulse amplifier 107 to the first electrode 105 to charge the ink droplet 110.

In the nozzle plate 1 according to the present embodiment, because the second electrode 106 grounded to the nozzle face 101 disposed opposite the print object 108 is provided, the surface of the print object 108 can be neutralized by the second electrode 106. With such a structure, an increase of the surface potential of the print object 108 can be prevented and the potential difference between the nozzle plate 1 and the print object 108 can be stabilized, thereby preventing the discharging failure.

FIGS. 2A to 2D each are plan views of the nozzle face 101 of the nozzle plate 1, explaining a forming pattern of the second electrode 106. As described above, the second electrode 106 is formed on an area of the nozzle face 101, in which the second electrode 106 does not contact, and does not electrically connect to the ink droplet 110 when the ink droplet 110 is discharged from the discharge port 102.

As illustrated in FIG. 2, the nozzle plate 1 includes a predetermined number of discharge ports 102 disposed in the longitudinal direction of the nozzle plate 1. Herein, a forming area of each discharge port 102 and a peripheral portion of the discharge port 102 are collectively called a discharge port forming area 120. The discharge port forming area 120 at lease includes an area where the second electrode 106, if provided, would directly contact or influence electrically to the ink droplet 110. That is, the area in the nozzle face 101 excluding the discharge port forming area 120 is an area where the second electrode 106 does not directly contact the ink droplet 110 or does not exert an electrical influence to the ink droplet 110.

As a result, the second electrode 106 is disposed in an area in the nozzle face 101 excluding the discharge port forming area 120. The forming area of the second electrode 106 is called an electrode forming area 121.

Figure 2A:
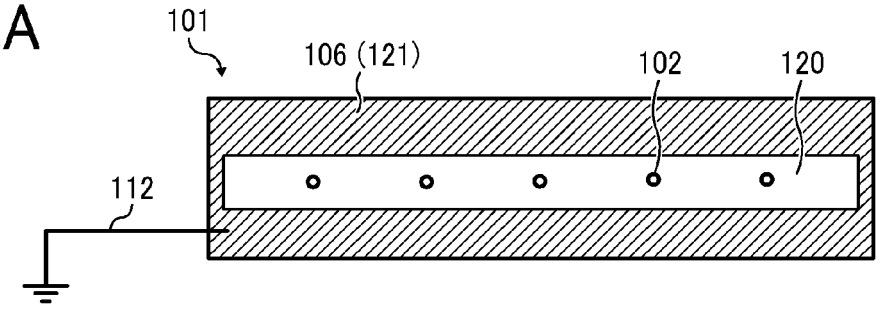
FIGS. 2A to 2D each illustrates a forming pattern of a second electrode on the nozzle face.
Figure 2B:
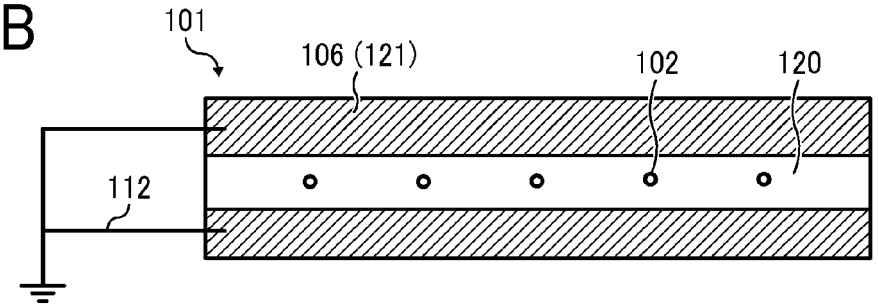

As illustrated in FIG. 2A, the electrode forming area 121 may be an outer peripheral portion of an entire of the discharge port forming area 120 along the alignment direction of the discharge port 102. Alternatively, as illustrated in FIG. 2B, the discharge port forming area 120 is set to an entire area along the alignment direction of the discharge port 102, and two electrode forming areas 121 are formed with the discharge port forming area 120 in between. Further, as illustrated in FIG. 2C, each discharge port 102 and its peripheral portion are set as an individual discharge port forming area 120, and the other area is set as the electrode forming area 121.

Figure 2C:
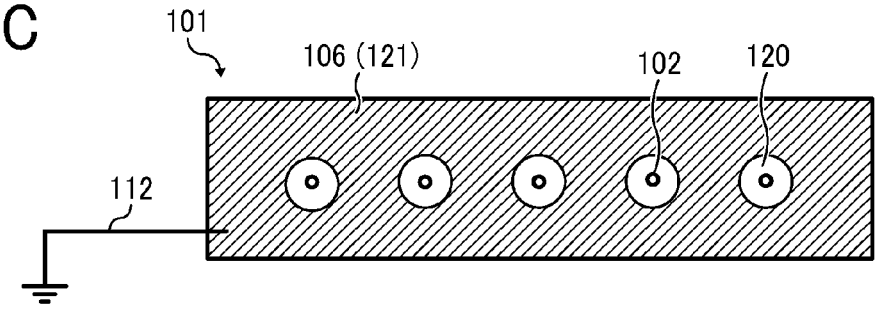
Figure 2D:
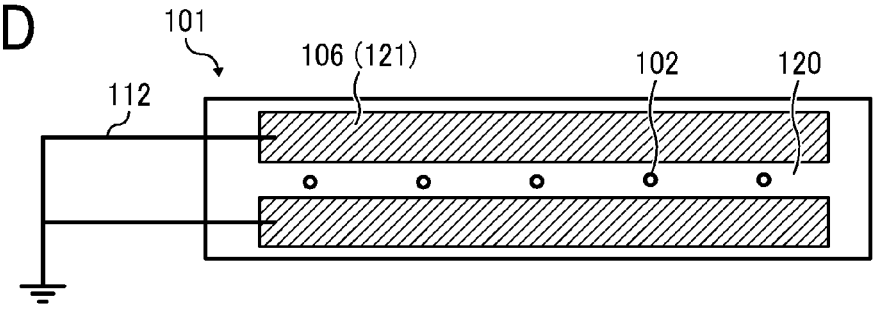
Figure 2D:
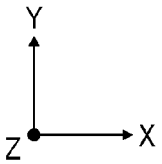

As illustrated in FIG. 2A to 2C, an entire surface other than the discharge port forming area 120 on the nozzle face 101 is preferably set as the electrode forming area 121 to effectively neutralize the print object 108; however, as illustrated in FIG. 2D, without setting the entire surface other than the discharge port forming area 120 as the electrode forming area 121, the second electrode 106 can be formed in a partial area.

In typical examples, the electrodes are disposed on the nozzle face of the inkjet head. However, the electrode as a driving device of the ink discharge disposed around the discharge port is supplied with voltage during ink discharging operation, and does not neutralize the ink liquid droplet 110 impacted on the print object 108. Further, the guard electrode is disposed to prevent interference of the electric field between adjacent discharging portions, because the surface of the guard electrode is further coated by the insulation layer, the guide electrode does not neutralize the ink liquid droplet 110 impacted on the print object 108.

Next, another nozzle plate according to the present embodiment will be described. A redundant description concerning the same structure as in the first embodiment as illustrated in FIG. 1 will be omitted.

Figure 3:
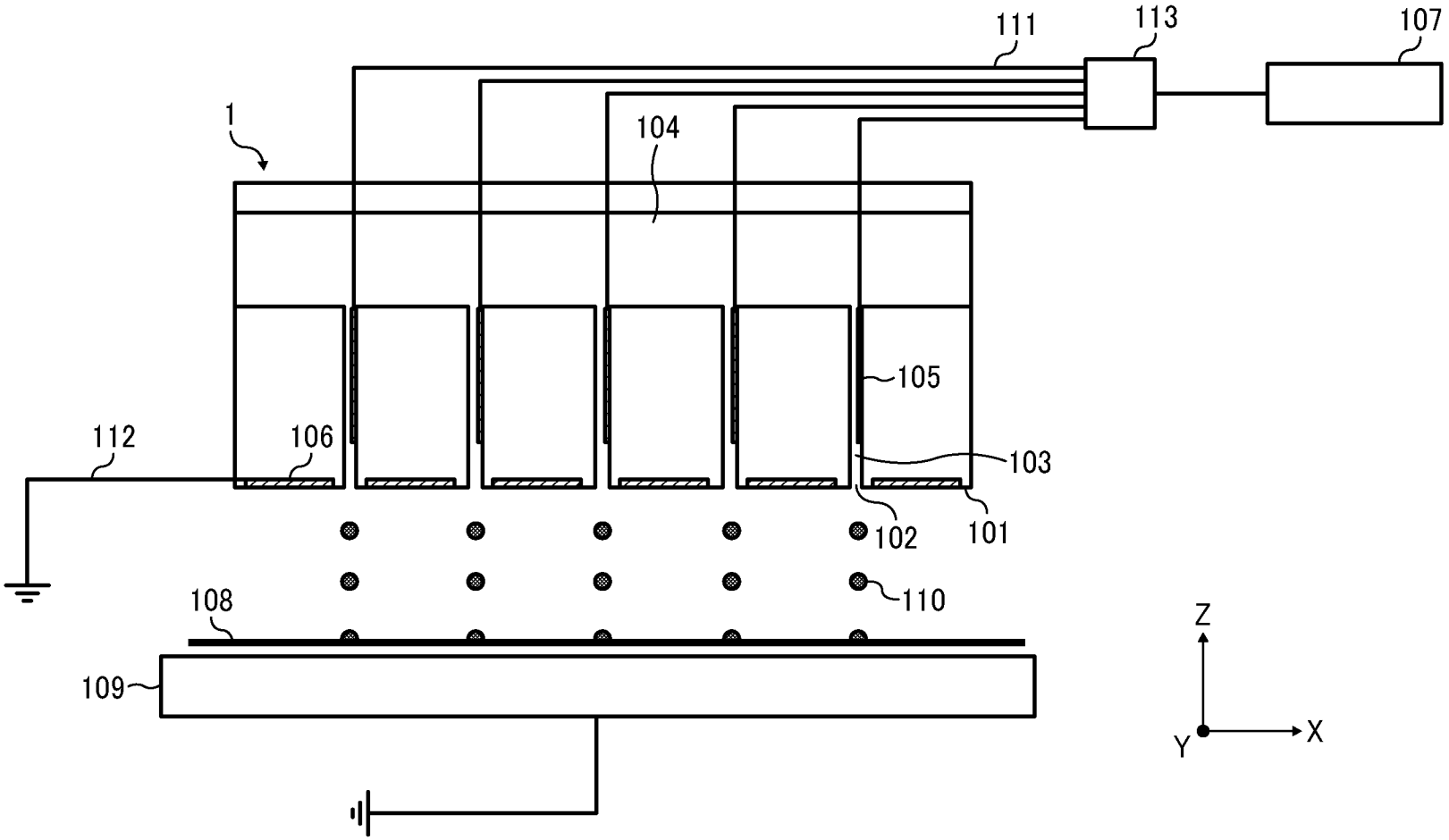
FIG. 3 illustrates a nozzle plate according to a second embodiment of the present invention.

FIG. 3 schematically illustrates an exemplary nozzle plate according to the second embodiment of the present invention and including a cross-sectional view of the nozzle plate with connection configuration of each electrode.

The first electrode 105 charges the ink until the ink is discharged from the nozzle plate 1, so that the first electrode 105 may be disposed at a position contacting the ink other than the inner wall surface of the discharge chamber 104.

The nozzle plate 1 as illustrated in FIG. 3 includes the first electrodes 105 respectively disposed on inner walls of the nozzle holes 103.

The nozzle plate 1 as illustrated in FIG. 3 does not include the first electrode 105 formed on the inner wall of the discharge chamber 104, but includes the first electrode 105 formed on a part of the inner wall of the nozzle hole 103. In this case, each first electrode 105 is connected to the high voltage pulse amplifier 107 via a parallel converter 113 as an output splitting device, and an output of the high voltage pulse amplifier 107 is split by the parallel converter 113 and is applied to the first electrode 105.

In the nozzle plate 1 as illustrated in FIG. 3, the ink filling the discharge chamber 104 that passes through the nozzle hole 103 to be discharged from the discharge port 102, is charged by the first electrode 105 at that time and is discharged to the print object 108.

Figure 4:
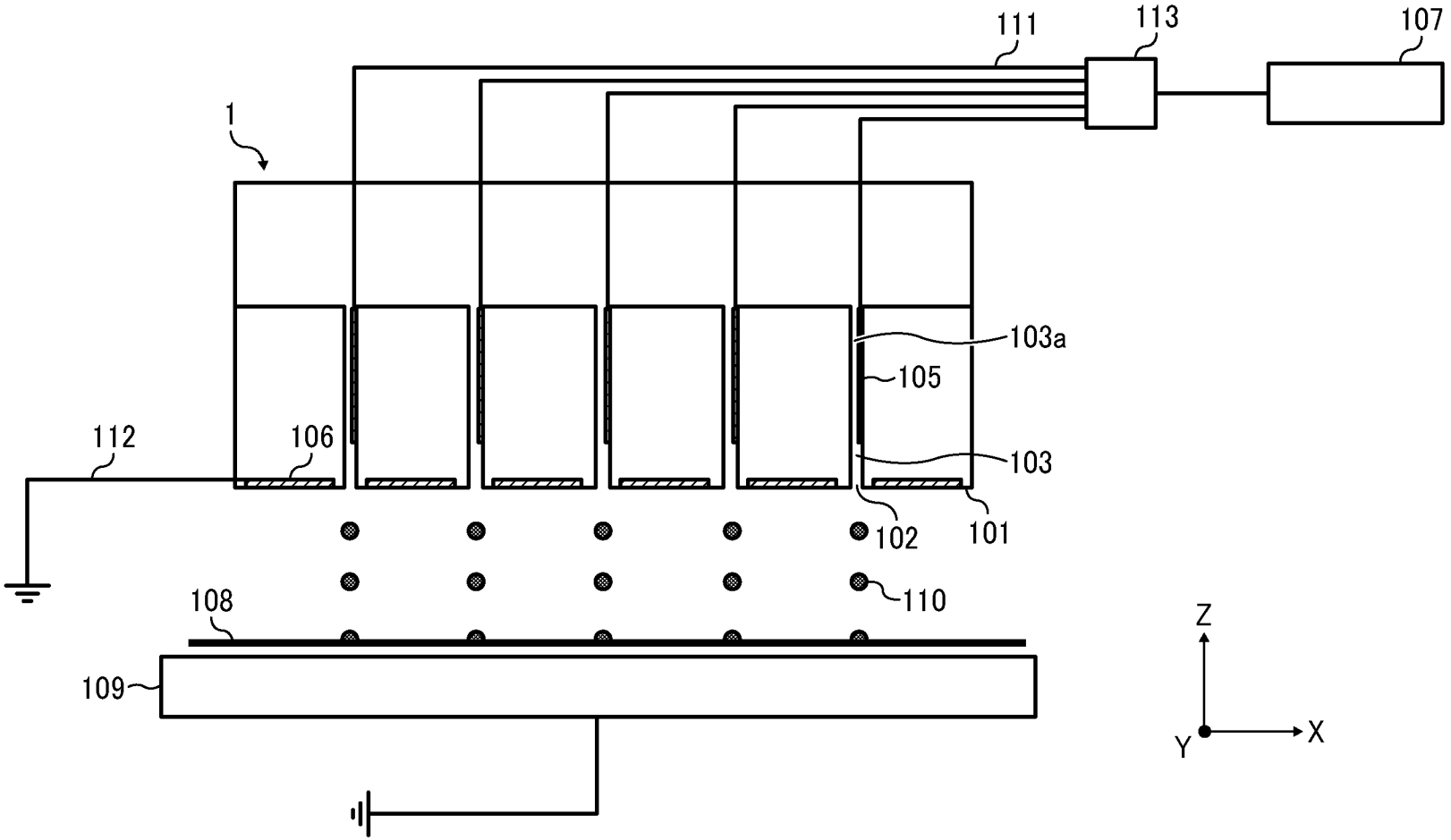
FIG. 4 illustrates a nozzle plate according to a third embodiment of the present invention.
Figure 5:
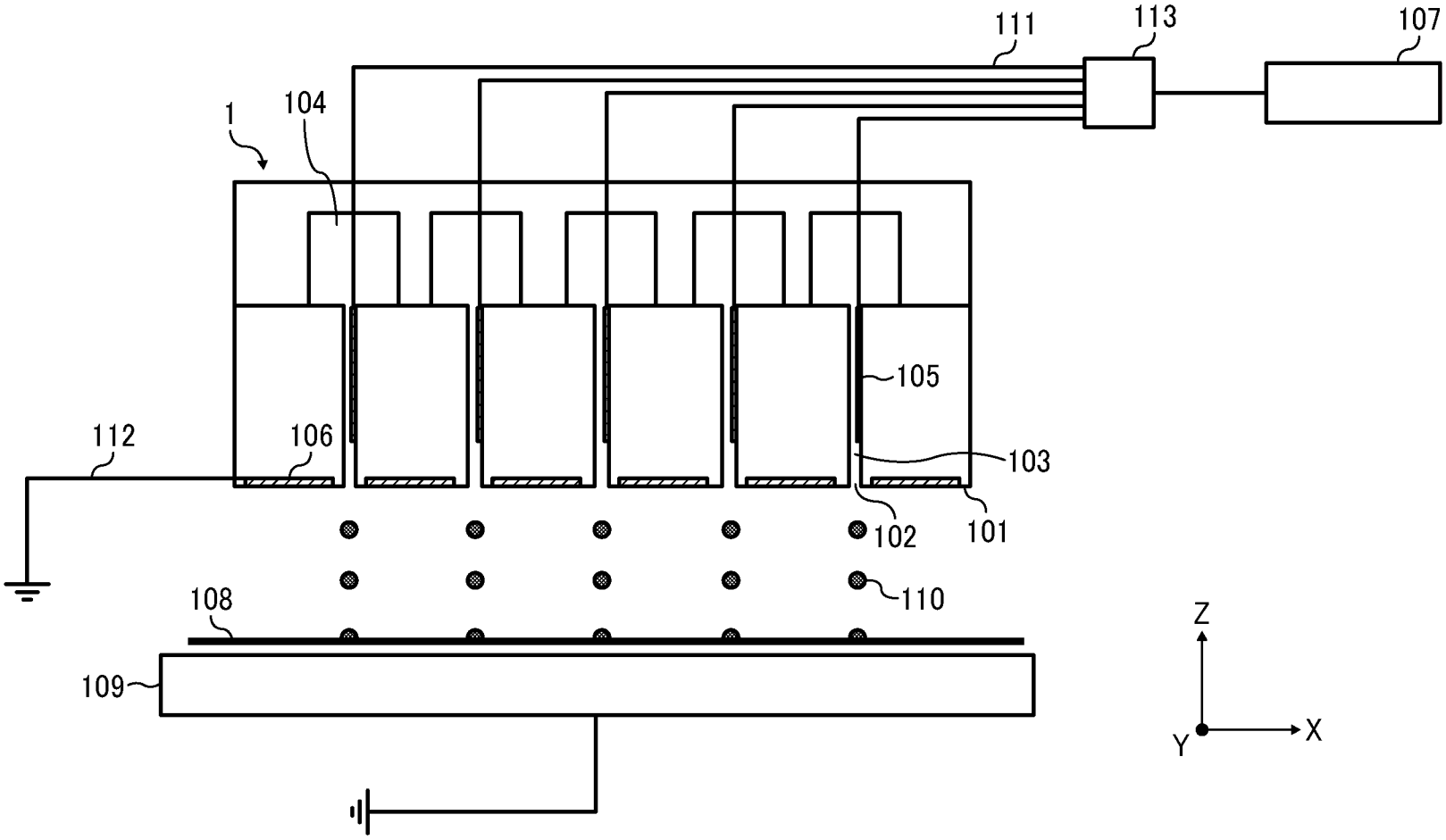
FIG. 5 illustrates a nozzle plate according to a fourth embodiment of the present invention.

FIGS. 4 and 5 schematically illustrate other exemplary nozzle plates according to the third and fourth embodiments of the present invention and each including a cross-sectional view of the nozzle plate with connection configuration of each electrode.

In the first and second embodiments, the nozzle plate 1 includes a common discharge chamber 104 disposed relative to the plurality of discharge ports 102. As illustrated in FIG. 4, the discharge chamber 104 is not disposed to the nozzle plate 1, and an ink channel 103*a* directly communicates with the nozzle hole 103. In addition, as illustrated in FIG. 5, an individual discharge chamber 104 is disposed to each discharge port 102, so that a discharge control can be performed as to each discharge port 102.

Figure 6:
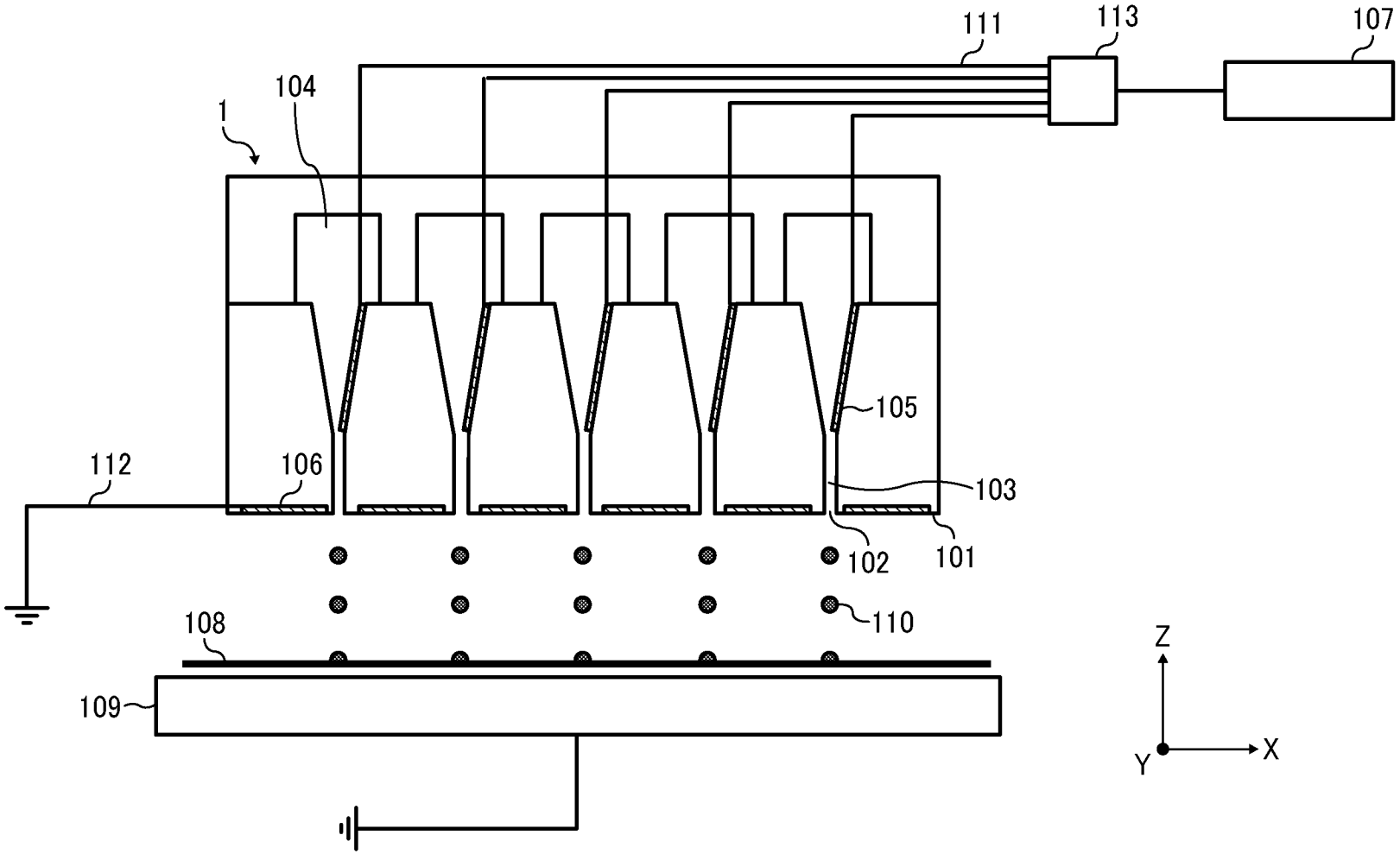
FIG. 6 illustrates a nozzle plate according to a fifth embodiment of the present invention.

FIG. 6 schematically illustrates another exemplary nozzle plate according to the fifth embodiment of the present invention including a cross-sectional view of the nozzle plate with connection configuration of each electrode.

In the first to fourth embodiments, the nozzle hole 103 is formed straight in the depth direction of the nozzle plate 1 from the discharge port 102 to the discharge chamber 104. However, as illustrated in FIG. 6, the nozzle hole 103 includes a tapered shape in a predetermined range from the discharge chamber 104 and a straight shape in the side of the discharge port 102. The configuration above improves the discharging property of the ink droplet 110. It is also preferred that the first electrode 105 be provided to the tapered shape portion of the nozzle hole 103.

Figure 7B:
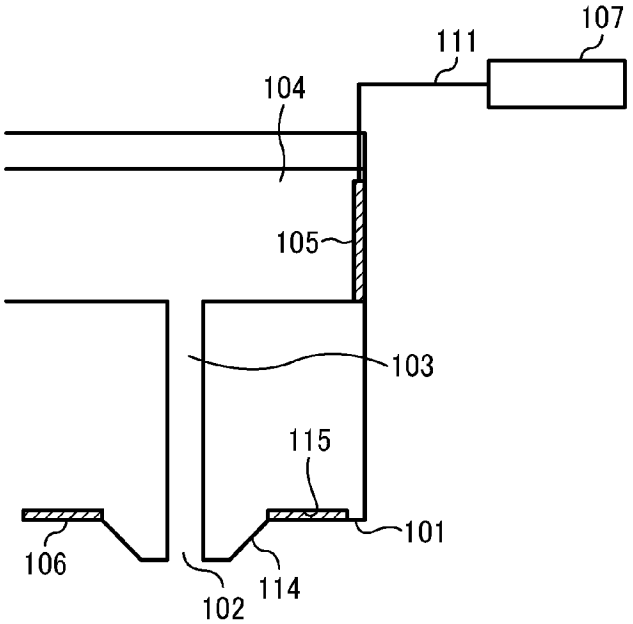
FIGS. 7A and 7B each illustrate a nozzle plate according to a sixth embodiment of the present invention.
Figure 7A:
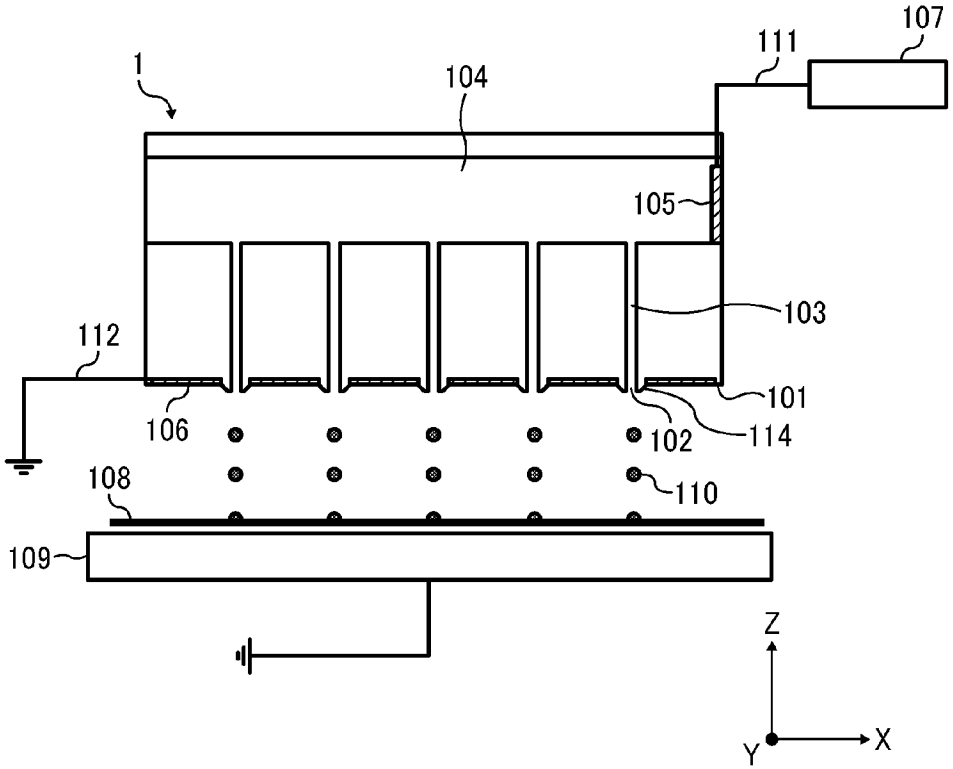
Figure 8B:
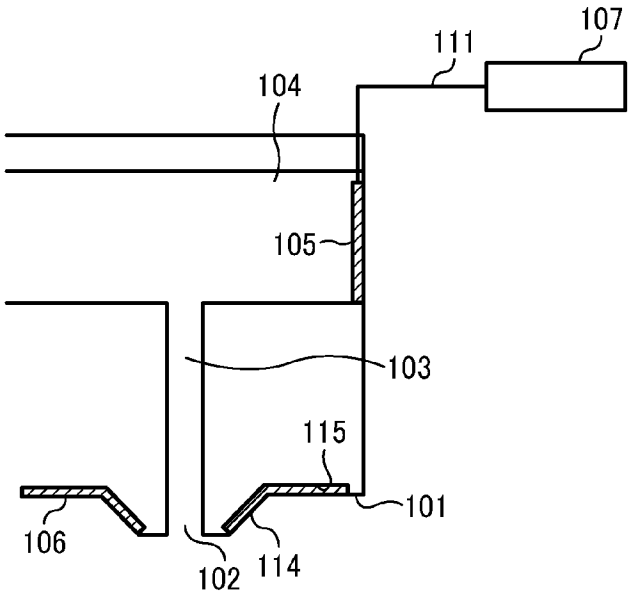
FIGS. 8A and 8B each illustrate a nozzle plate according to a seventh embodiment of the present invention.
Figure 8A:
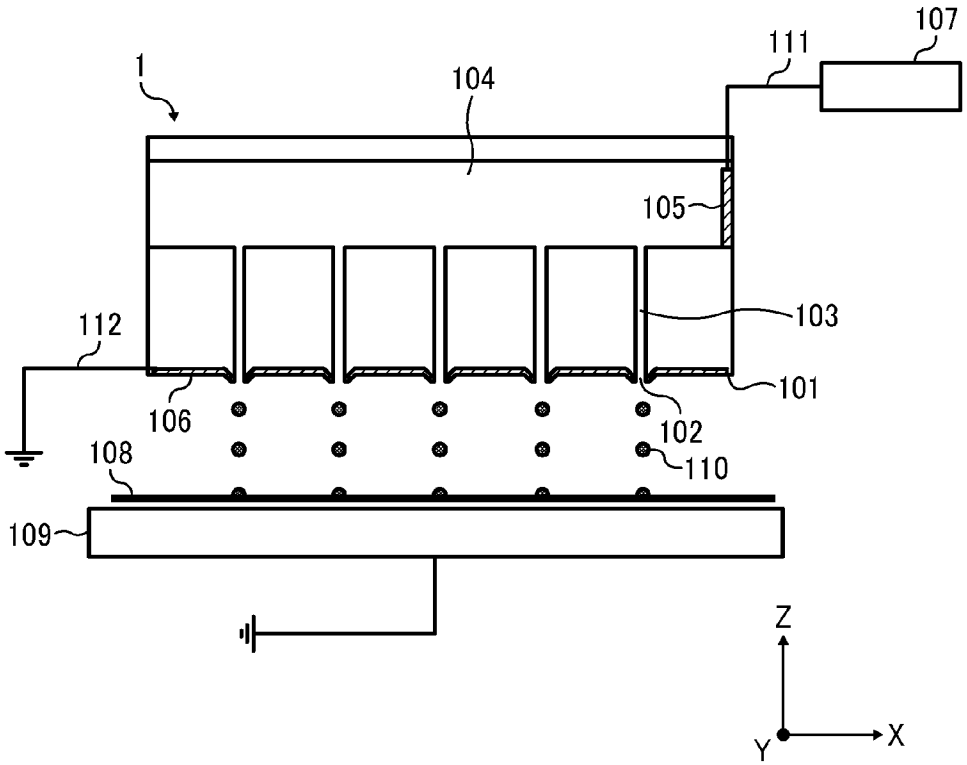

FIGS. 7A and 7B and FIGS. 8A and 8B schematically illustrate other exemplary nozzle plates according to the sixth and seventh embodiments of the present invention. FIGS. 7A and 8A are cross-sectional views of the nozzle plate with connection configuration of each electrode. FIGS. 7B and 8B each are an enlarged partial view of FIGS. 7A and 8A, respectively.

In the first to fourth embodiments, the nozzle face 101 is flatly formed. As illustrated in FIGS. 7A through 8B, a peripheral portion of the discharge port 102 is protruding from the nozzle face 101. The protruding shape from the nozzle face 101 is called a projection 114. Provision of the projection 114 improves the discharging property of the ink droplet 110. Adhesion of the ink droplet 110 to the nozzle face 101 can be prevented.

A forming pattern of the second electrode 106 including the projections 114 in the nozzle plate 1 will be described.

As illustrated in FIG. 7, the second electrode 106 can be disposed on a flat portion 115 of the nozzle face 101. As illustrated in FIG. 8, it is also preferred that the second electrode 106 be disposed on a part of the projection 114 in addition to the flat portion 115 of the nozzle face 101. The part of the projection 114 excludes an area forming the discharge port 102.

The first to seventh exemplary structures of the nozzle plate 1 can be used in any combination. For example, the nozzle hole 103 can be tapered (as in the fifth example) and the nozzle face 101 can be provided with a projection (as in the sixth and seventh examples). Further, in an example including the discharge chamber 104, the first electrode 105 can be disposed extending from the discharge chamber 104 to the nozzle hole 103.

Due to the nozzle plate as described heretofore according to the present embodiment, with a simplified structure providing the grounding electrode on the nozzle face, the surface potential is prevented from rising even though the print object is an insulating material in the electrostatic absorption type inkjet device. As a result, the discharging failure can be prevented from occurring.

Inkjet Head

Next, a method for producing a laminated plate having a nozzle plate according to the present embodiment, and a method of constructing an inkjet head as an example of the liquid droplet discharge head having the above laminated plate, will now be described.

Figure 9A:
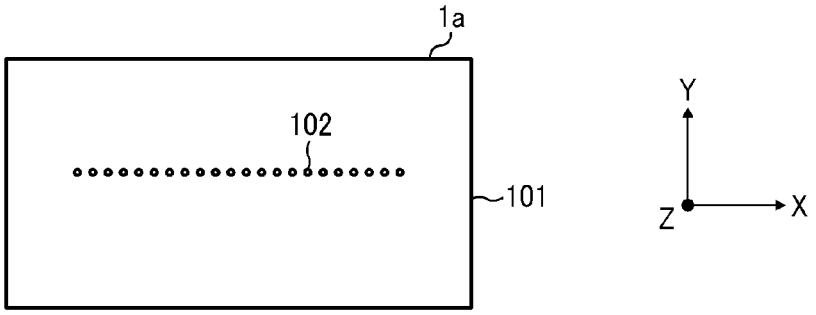
FIGS. 9A to 9C each are a plan view illustrating each substrate constructing an inkjet head.
Figure 9B:
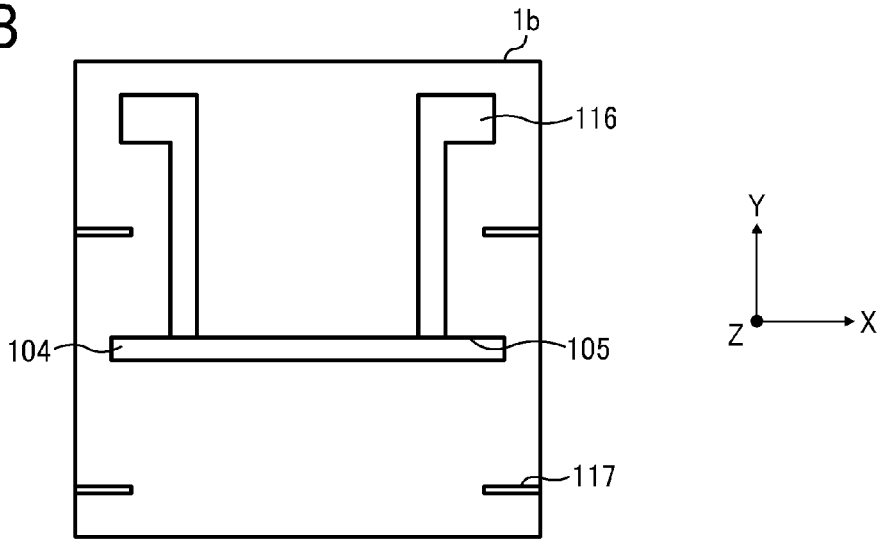
Figure 9C:
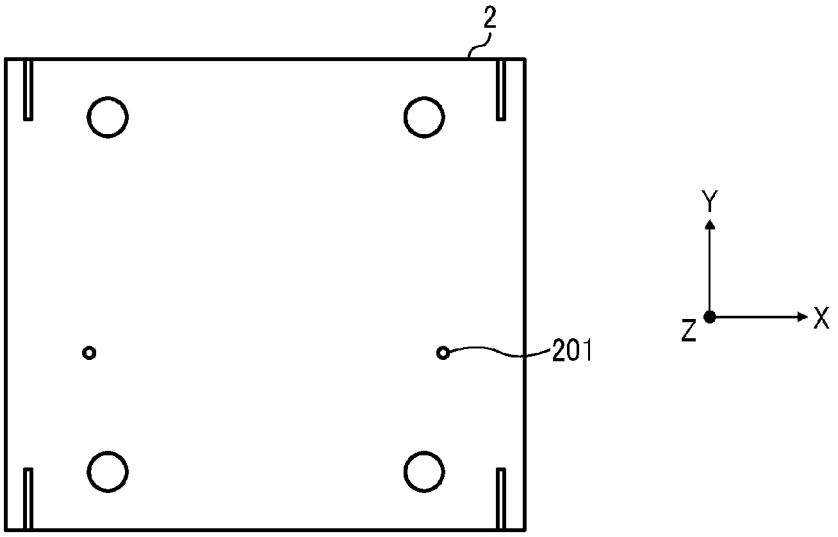

The inkjet head according to the present embodiment includes the nozzle plate 1 and a channel connected to the nozzle plate 1 to supply the ink droplet 110. FIGS. 9A to 9C each are a plan view illustrating each substrate constructing an inkjet head.

In printed electronics, depending on the purpose of wiring, a semiconductor film, and an insulation film, various film thicknesses should be controlled and various ink properties should be handled. In addition, because there are many types of solutions of ink, from an aqueous system to organic solvent medium and acid ink, chemical durability is required for the materials for the inkjet head.

As a result, as the material for the nozzle plate 1, a substrate with optimal chemical and physical durability and high surface flatness and smoothness is required. For example, an oxide glass substrate such as $SiO_2$ glass and borosilicate glass, a monocrystalline substrate formed of quarts, safire, and Si, may be employed.

In the present embodiment, the nozzle plate 1 may include a first substrate 1*a* in which the discharge port 102 and the nozzle hole 103 are formed, and a second substrate 1*b* in which the discharge chamber 104 is formed. The first substrate 1*a* is a nozzle forming substrate and the second substrate 1*b* is the liquid chamber forming substrate. The nozzle plate 1 may alternatively be formed of a single substrate, and the discharge port 102, the nozzle hole 103, and the discharge chamber 104 are formed in the single substrate.

FIG. 9A is a plan view of the first substrate 1*a* in which the discharge port 102 and the nozzle hole 103 are formed, and represents the nozzle face 101 opposed to the print object 108. First, a fluorine water repellent material is laminated on the nozzle face 101 of the first substrate 1*a* in which the nozzle hole 103 is open to a predetermined direction, by spin coating. Next, the first substrate 1*a* is dried by an oven at 60 degrees C. for 30 min. and the surface thereof is subject to a hydrophobic treatment.

FIG. 9B is a plan view of the second substrate 1*b* in which the discharge chamber 104 is formed, and represents a joint surface with the first substrate 1*a*. An electrode 116 is formed on the second substrate 1*b* in which the discharge chamber 104 is formed, via a metal masque. Specifically, a film of Mo with a thickness of 200 nm is formed on the second substrate 1*b* using a sputtering device. In this case, the electrode film that is electrically connected to the electrode 116 is formed on an inner wall of the discharge chamber 104. This electrode film is the first electrode 105.

FIG. 9C is a plan view of an ink injection plate 2 on which an ink injection port 201 to inject the ink from outside to the discharge chamber 104 of the nozzle plate 1 is formed, and represents a joint surface with the second substrate 1*b*.

Then, the first substrate 1*a* is laminated with the second substrate 1*b* along an alignment mark 117 disposed on the second substrate 1*b* with a UV curing resin, to thereby form a nozzle plate 1. Next, the ink injection plate 2 is laminated on the second substrate 1*b* of the nozzle plate 1 with the UV curing resin, to thereby form a laminated plate 3.

Finally, a film of Al with a thickness of 200 nm is formed on an area excluding the discharge port forming area in the nozzle face 101 of the thus formed laminated plate 3 via the metal masque using a sputtering device, which is the second electrode 106.

Figure 10B:
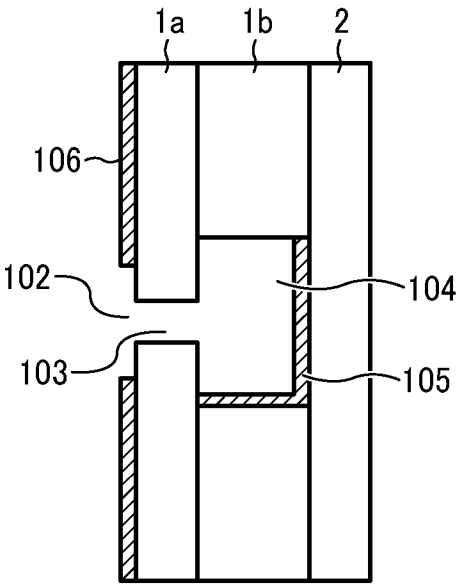
Figure 10A:
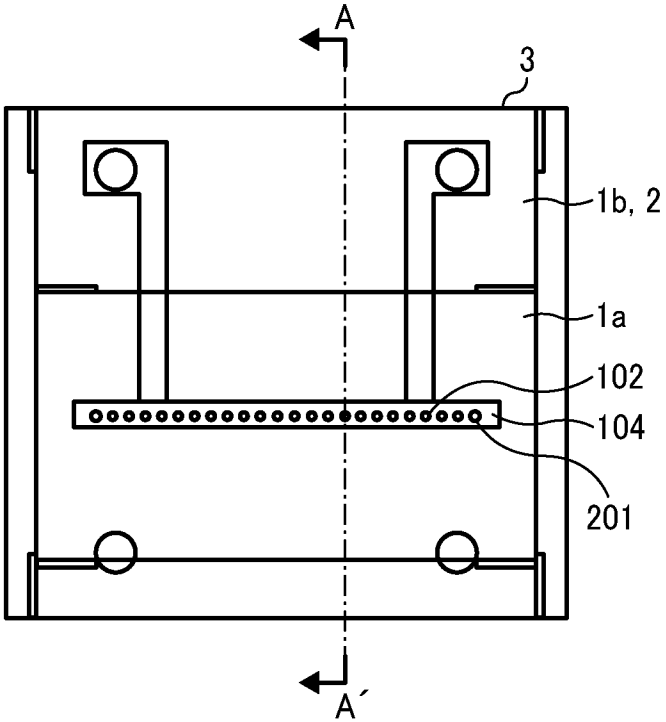

FIG. 10A is a plan view of the formed laminated plate 3, viewed from the side of the nozzle face 101. Each substrate is represented in a transparent state for simplification. FIG. 10B is a cross-sectional view of the discharge chamber forming section along a broken line A-A' in FIG. 10A.

In the present embodiment, Mo is used as a material for the first electrode and Al is used as a material for the second electrode, but the materials for the electrode are not limited to the above, and other metals and alloys such as Pt, Au, Cu, Ni, Cr, W, Nb, and Ta can be used. Further, a multi-layered film of transparent conductive oxides such as ITO, ATO, and AZO can be formed by sputtering and vacuum deposition. The same material may be used for both the first electrode and the second electrode.

In the above example, after lamination of the nozzle plate 1 and the laminated plate 3, the second electrode 106 is laminated; however, after formation of the first substrate 1*a*, the second electrode 106 can be formed before lamination of the second electrode 106 and the ink injection plate 2.

Further, in the above example, after formation of the water repellent film on the nozzle face 101, the water repellent treatment is performed, and the second electrode 106 is laminated (with the water repellent film disposed at a bottom layer and the second electrode 106 at an upper layer); however, the water repellent film is formed after the formation of the second electrode 106, and the water repellent treatment can be performed (with the second electrode 106 at a bottom layer and the water repellent film at an upper layer).

Figure 11:
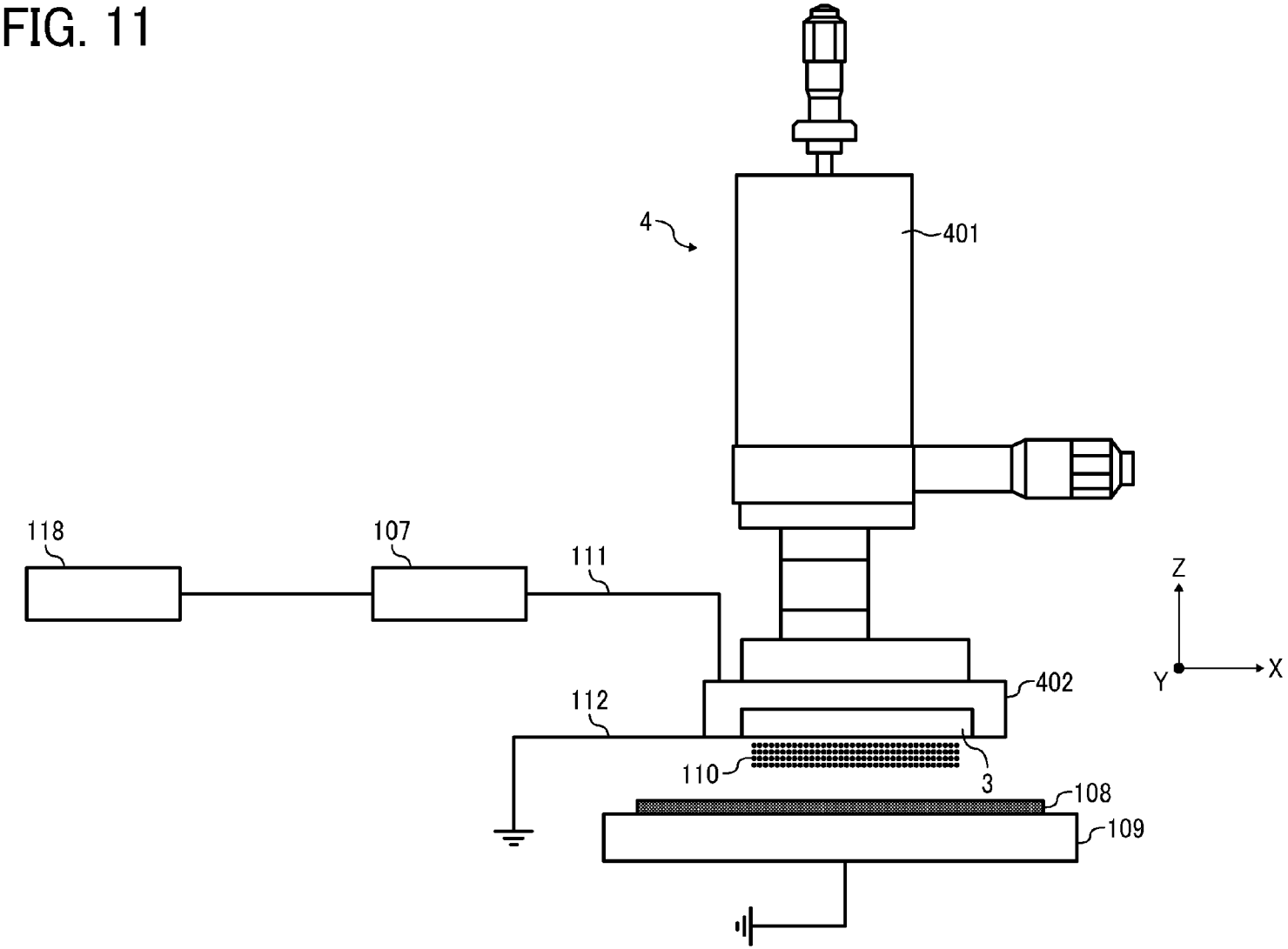
FIG. 11 schematically illustrates an example of a structure of an inkjet head.

FIG. 11 schematically illustrates an example of a structure of an inkjet head 4 including the laminated plate 3.

The laminated plate 3 is mounted on a plate holder 402 mounted on a direction position adjuster 401 of the inkjet head 4. The first electrode 105 of the laminated plate 3 is connected to the high voltage pulse amplifier 107 and the second electrode 106 is grounded.

The grounding of the second electrode 106 is not limited in particular, and, for example, the wire 112 from the second electrode 106 is extended from the inkjet head 4 to a stage 109 via an inkjet recording apparatus (see FIG. 12) including the inkjet head 4 and is grounded.

The first electrode 105 of the laminated plate 3 is connected to the high voltage pulse amplifier 107, which is connected to a controller 118 for controlling an upper device such as an inkjet recording apparatus and the controller of the inkjet recording apparatus. Then, based on a driving signal from the controller 118, voltage is applied from the high voltage pulse amplifier 107 to the first electrode 105 inside the laminated plate 3. The electrically charged ink droplet 110 discharged from the nozzle hole 103 due to electrostatic force, is impacted on the print object 108 placed on the stage 109.

The ink may be previously injected in the discharge chamber 104 from the ink injection port 201 of the ink injection plate 2, or otherwise, the ink may be fed to the discharge chamber 104 from an ink tank via a tube communicating with the ink tank, to the ink injection port 201. Alternatively, an ink waste port is provided and the ink is collected and filtered, and the ink can be again supplied from the ink supply port in a cyclical method.

Inkjet Recording Apparatus

Next, an inkjet recording apparatus, and an inkjet recording system employing the inkjet recording apparatus as one embodiment of the liquid droplet discharge device according to the present invention will be described.

The inkjet recording apparatus according to the present embodiment is a liquid droplet discharge device to discharge liquid droplets to the print object 108, and includes an inkjet head 4, a high voltage pulse amplifier 107 connected to a first electrode 105, a stage 109 including an XYZ θ stage 502 and an absorption table 503, and an XYZ θ stage shifting indicator 542 that shifts the inkjet head 4 and the stage 109 relatively.

Figure 12:
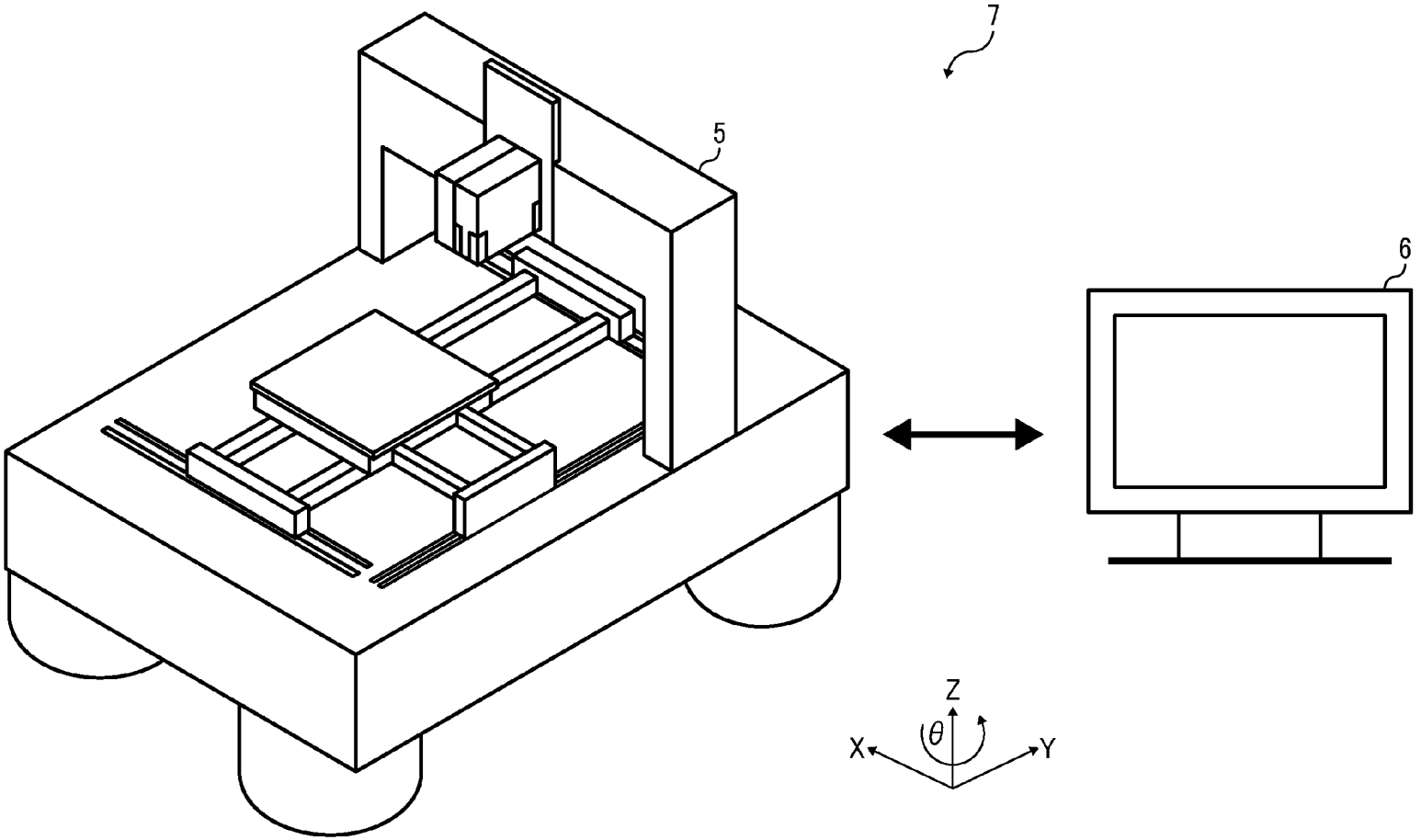
FIG. 12 schematically illustrates an example of an inkjet recording system.

FIG. 12 is a perspective view illustrating an exemplary inkjet recording system 7. As illustrated in FIG. 12, a Z-axis indicates a vertical direction and a θ-axis indicates a rotation direction relative to the vertical direction. In addition, an X-axis and a Y-axis are perpendicular to each other, and are perpendicular to the Z-axis, so that a three-dimensional coordinate system is formed.

The inkjet recording system 7 includes an inkjet recording apparatus 5 and a controller apparatus 6, communicably connected to each other. The inkjet recording apparatus 5 employs the inkjet head 4 that discharges ink droplets to the print object 108, to thereby perform a liquid droplet discharge. The inkjet recording system 7 performs patterning with a high precision necessary for producing electronic devices using the inkjet recording apparatus 5.

The controller apparatus 6 controls operation of the inkjet recording apparatus 5 and is connected to the inkjet recording apparatus 5 via a communication interface. The controller apparatus 6 is constructed of information processor such as a personal computer. As one example of the controller apparatus 6, a case in which an embodiment of the present invention is applied to the personal computer will be described, but is not limited thereto, and various types of information processors to which the present invention is applied are possible. For example, any mobile information terminals such as a smart phone or a tablet PC can be used.

The system configuration as illustrated in FIG. 12 is also an example, and does not limit a scope of the present invention. For example, functions performed by the controller apparatus 6 can be incorporated in the inkjet recording apparatus 5.

Figure 13:
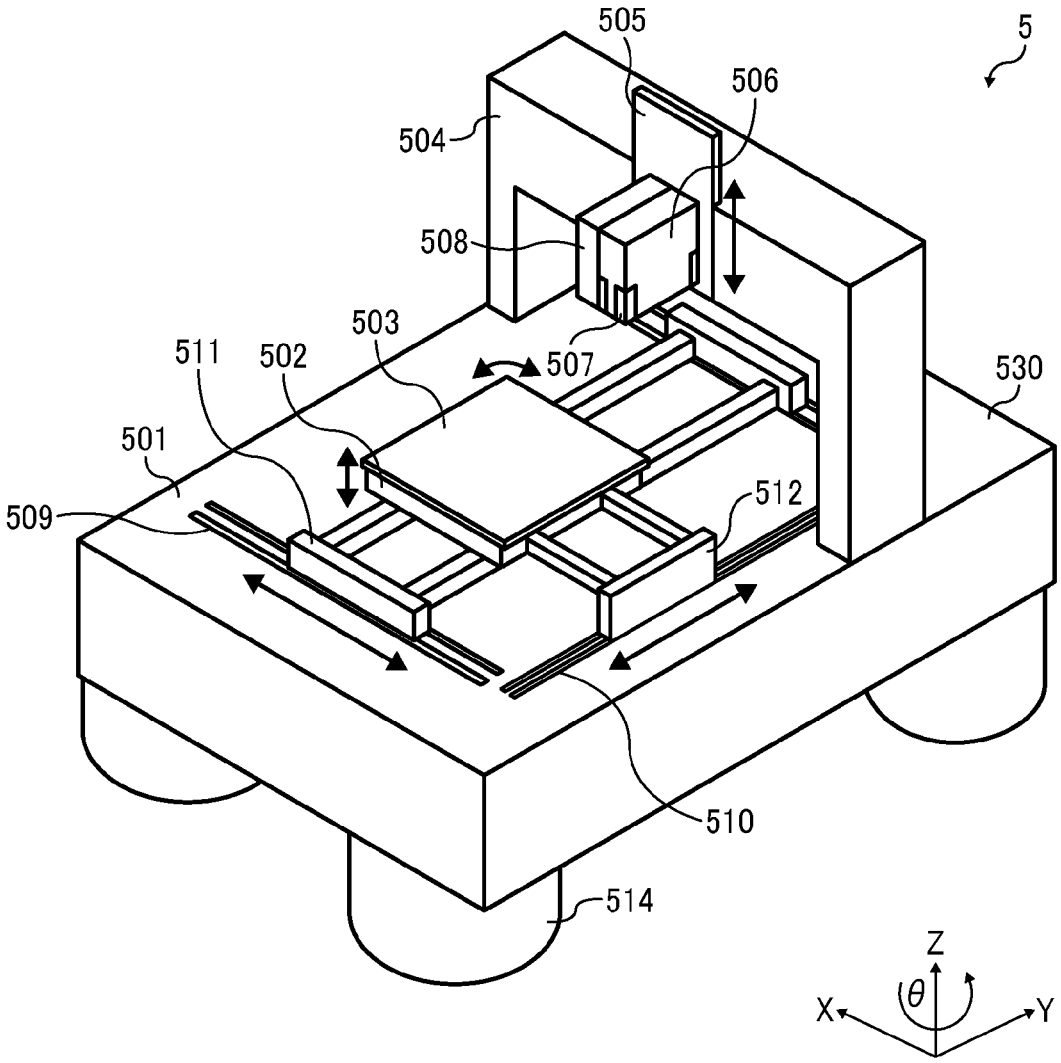
FIG. 13 is a perspective view illustrating an exemplary inkjet recording apparatus.

FIG. 13 is a perspective view illustrating an exemplary inkjet recording apparatus 5. The inkjet recording apparatus 5 includes a surface plate 501, the XYZ θ stage 502, the absorption table 503, a gantry 504, a gantry Z stage 505, an inkjet head unit 506, a work gap measuring unit 507, a camera unit 508, an X-axis guide rail 509, a Y-axis guide rail 510, an X-axis linear shifting stage 511, a Y-axis linear shifting stage 512, a Z-axis linear shifting stage 513, an anti-vibration table 514, and a controller 530.

The surface plate 501 includes the X-axis guide rail 509 and the Y-axis guide rail 510 on which the XYZ θ stage 502 can be mounted to be reciprocally movable, and the gantry 504 on which the gantry Z stage 505 is mounted to be reciprocally movable vertically, and the anti-vibration table 514 to cutoff vibration from an environment.

The X-axis linear shifting stage 511 reciprocally movable along the X-axis guide rail 509 secured to the surface plate 501 is disposed in the X-axis direction of the XYZ θ stage 502. The Y-axis linear shifting stage 512 reciprocally movable along the Y-axis guide rail 510 secured to the surface plate 501 is disposed in the Y-axis direction of the XYZ θ stage 502. The Z-axis linear shifting stage 513 reciprocally movable along the Z-axis direction is disposed between the XYZ θ stage 502 and the absorption table 503 in the Z-axis direction of the XYZ θ stage 502. A rotary stage capable of cyclically moving back and forth is disposed between the XYZ θ stage 502 and the absorption table 503 in the θ-axis direction of the XYZ θ stage 502.

The absorption table 503 is secured to the XYZ θ stage 502 and serves as a table on which the print object 108 is stuck with absorption force. The stage 109 as illustrated in FIG. 1 is configured by the XYZ θ stage 502 and the absorption table 503. The print object 108 is secured to the absorption table 503 by making a pressure between the absorption table 503 and the print object 108 to be reduced or to zero. For example, the surface of the absorption table includes a plurality of air voids to reduce the pressure or to a state near to null, and the plurality of air holes are connected to a vacuum pump as an absorption device via pipes connecting to the air holes.

The gantry 504 includes a gate structure and is secured to the surface plate 501 so as to overpass the XYZ θ stage 502 and the absorption table 503. The gantry Z stage 505 is so disposed to the gantry 504 as to be reciprocally movable in the Z-axis direction. The inkjet head unit 506 and the camera unit 508 is mounted on the gantry Z stage 505.

The gantry Z stage 505 is configured to be reciprocally movable in the Z-axis direction by a controllable drive unit including a servo device, such as a linear motor. The gantry Z stage 505 is controlled via the drive unit such that the inkjet head unit 506 and the camera unit 508 position at predetermined X-axis coordinates based on a predetermined control amount.

The inkjet head unit 506 includes N-number of inkjet heads 4 ($N \geq 1$) capable of discharging liquid droplets and a discharge device to discharge liquid droplets. The liquid droplet discharged from the discharge device is, for example, a coating liquid of functional materials to form an electronic device. The type and state of the liquid droplet is not limited in particular and may be ink or a viscous liquid.

The work gap measuring unit 507 measures a distance between the inkjet head unit 506 and the absorption table 503, which is referred to as a work gap. The work gap may be a distance between the inkjet head unit 506 and the print object 108 placed on the absorption table 503.

The work gap measuring unit 507 employs a light emitter such as laser beams as a measuring unit to measure the work gap. As illustrated in FIG. 13, each work gap measuring unit 507 is disposed at one of the four corners of the inkjet head unit 506 as an example.

The camera unit 508 is configured to take a picture of the print object 108 vertically along the Z-axis direction relative to a print surface of the print object 108 placed on the absorption table 503, and within a shifting range of the XYZ θ stage 502. The camera unit 508 employs a CCD camera for use in a normal alignment camera or a photo-capturing device having a similar capability.

Figure 14:
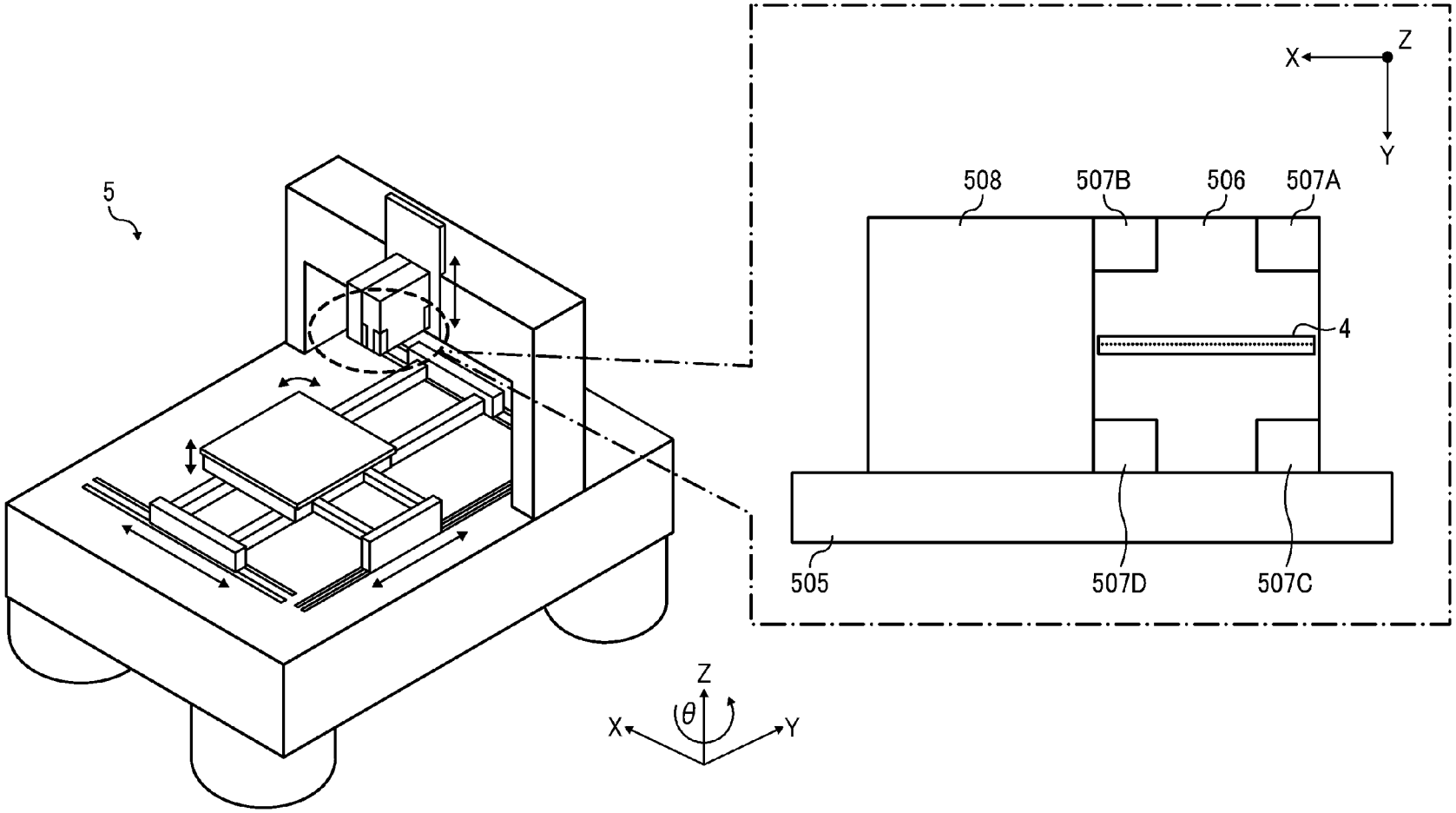
FIG. 14 illustrates the inkjet head unit and its environmental structure viewed from a placement surface of the print object on the absorption table toward a Z-axis vertical direction.

FIG. 14 illustrates the inkjet head unit 506 and its environmental structure in detail. FIG. 14 illustrates the inkjet head unit 506 and its environmental structure viewed from a placement surface of the print object 108 in the absorption table 503 toward the Z-axis vertical direction. FIG. 14 illustrates, as a figure around the inkjet head unit 506, the gantry Z stage 505, the inkjet head unit 506, the work gap measuring unit 507, and the camera unit 508 viewed from the absorption table 503 toward the Z-axis vertical direction.

The camera unit 508 is not always mounted on the gantry Z stage 505, and can instead be directly secured to the gantry 504, or otherwise, any other equipment can be used to secure the camera unit 508.

The inkjet head unit 506 includes the inkjet head 4 and the work gap measuring units 507A, 507B, 507C, and 507D. Measurement of the work gap by the work gap measuring units 507A, 507B, 507C, and 507D will be described referring to FIG. 15.

Figure 15:
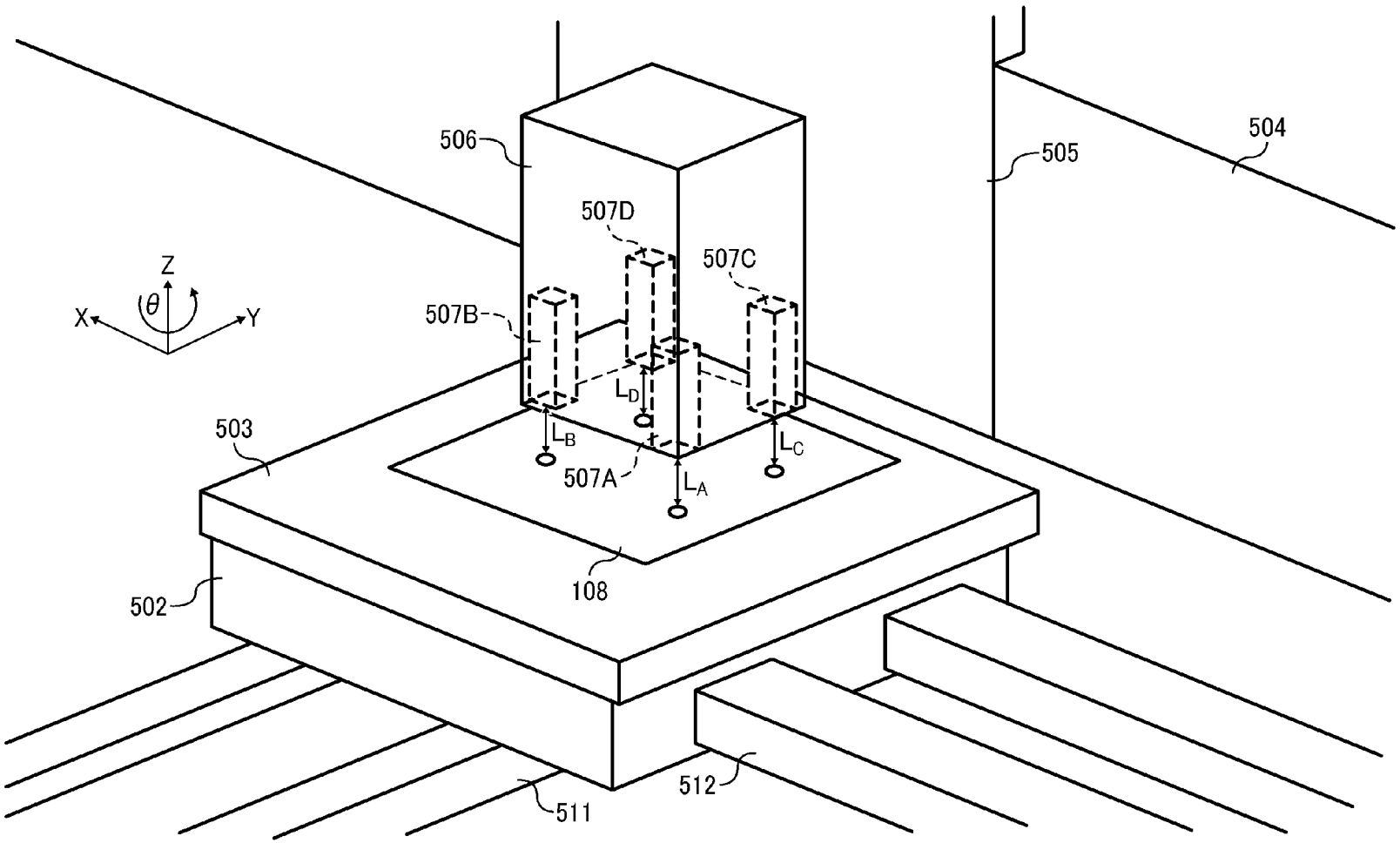
FIG. 15 illustrates measurement of a work gap by a work gap measuring unit.

As illustrated in FIG. 15, the work gap measuring units 507A, 507B, 507C, and 507D are mounted at four corners of the inkjet head unit 506. The work gap measuring units 507A, 507B, 507C, and 507D can be mounted detachably to the inkjet head unit 506.

As illustrated in FIG. 15, the work gap measuring units 507A, 507B, 507C, and 507D are mounted at four corners of the inkjet head unit 506, but the mounting position of each of the work gap measuring units 507A, 507B, 507C, and 507D is not limited to this. As far as the relative position between the inkjet head 4 and the work gap measuring unit 507 is kept constant, the position of the work gap measuring unit 507 is arbitrarily selectable.

The number of the work gap measuring units 507 is also changeable. Preferably, a plurality of work gap measuring units 507 should be disposed to measure the work gap correctly, at an equal distance from a gravitational center of the inkjet head unit 506.

The work gap measuring units 507A, 507B, 507C, and 507D emit laser beams to the print object 108 placed on the absorption table 503 or to the absorption table 503. The work gap measuring units 507A, 507B, 507C, and 507D receives a reflection light of the laser beams emitted from each of the work gap measuring units 507A, 507B, 507C, and 507D itself to the print object 108 or to the absorption table 503.

The work gap measuring units 507A, 507B, 507C, and 507D measures a work gap L based on the time when each work gap measuring unit itself emitted laser beams and the time when each work gap measuring unit receives the reflected light from the print object 108 or the absorption table 503. Calculation of the work gap L from the output time of the laser beams and the reflected-light received time is performed using a previously stored characteristic value for the laser beams used for measurement. The work gap measuring units 507A, 507B, 507C, and 507D transmit measured work gaps LA, LB, Lc, and LD to the controller apparatus 6 as measurement results.

The X-axis linear shifting stage 511 reciprocally movable along the X-axis guide rail 509 secured to the surface plate 501 is disposed in the X-axis direction of the XYZ θ stage 502. The X-axis linear shifting stage 511 is configured to be reciprocally movable in the X-axis direction by a controllable drive unit such as a linear motor including a servo device. The X-axis linear shifting stage 511 is configured such that the absorption table 503 positions at a predetermined X-axis coordinates via the drive unit. The positional precision in the X-axis in this case preferably includes a precision from submicron to 10 μm to produce a high precision electronic device.

The Y-axis linear shifting stage 512 reciprocally movable along the Y-axis guide rail 510 secured to the surface plate 501 is disposed in the Y-axis direction of the XYZ θ stage 502. The Y-axis linear shifting stage 512 is configured to be reciprocally movable in the Y-axis direction by a controllable drive unit such as a linear motor including a servo device. The Y-axis linear shifting stage 512 is configured such that the absorption table 503 positions at a predetermined Y-axis coordinates via the drive unit. The positional precision in the Y-axis in this case preferably includes a precision from submicrons to 10 μm to produce a high precision electronic device.

The Z-axis linear shifting stage 513 reciprocally movable along the Z-axis direction is disposed between the XYZ θ stage 502 and the absorption table 503 in the Z-axis direction of the XYZ θ stage 502.

A rotary stage capable of cyclically moving back and forth is disposed between the XYZ θ stage 502 and the absorption table 503 in the θ-axis direction of the XYZ θ stage 502.

The rotary stage is configured to be rotatable in a predetermined rotary axis direction via the controllable drive unit such as a linear motor including a servo device. In addition, the rotary stage is configured such that the absorption table 503 positions at a predetermined θ-axis position based on a predetermined control amount. The θ-axis in this case is mainly used in an initial operation when the print object 108 is placed.

Figure 16:
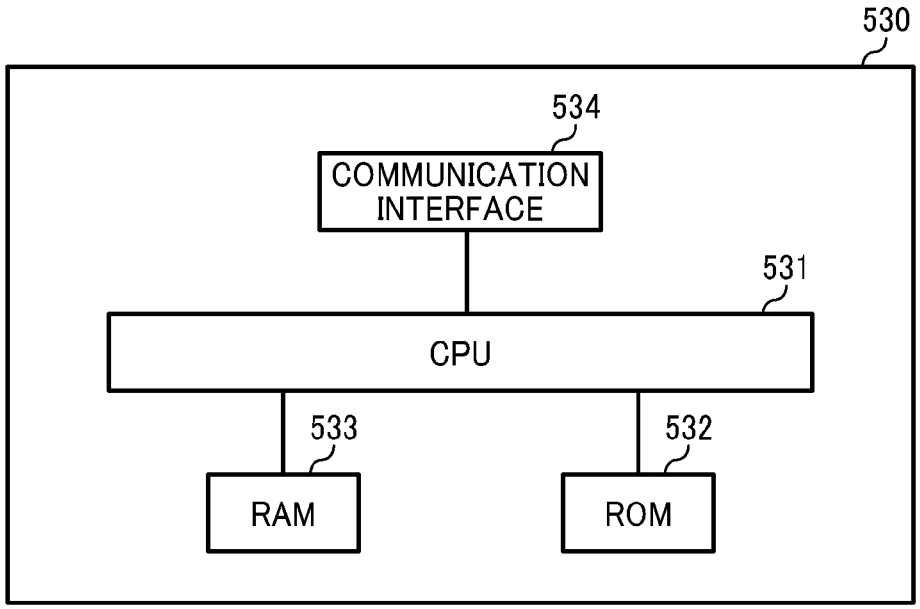
FIG. 16 illustrates an exemplary hardware configuration of a controller included in the inkjet recording apparatus.

The controller 530 as illustrated in FIG. 16 controls operation of the inkjet recording apparatus 5. Referring to FIG. 16, an exemplary hardware configuration of the controller 530 included in the inkjet recording apparatus 5 will be described.

The controller 530 includes a CPU 531, a read-only memory (ROM) 532, a random access memory (RAM) 533, and a communication interface 534.

The CPU 531 performs a program stored in the ROM 532.

The ROM 532 is a read-only memory for storing a program or data. The ROM 532 previously stores a program that the CPU 531 executes calculation function and control function and related data for the CPU 531 to execute calculation and controlling.

The RAM 533 is a writable and readable memory used for decompression of the program and data.

The communication interface 534 is an interface for communication with the controller apparatus 6 and the controller 530 can communicate with the controller apparatus 6 via the communication interface 534. The communication interface 534 communicates with the controller apparatus 6 via wired and wireless communication.

Next, a function performed by the CPU 531 included in the controller 530 will be described referring to FIG. 17.

Figure 17:
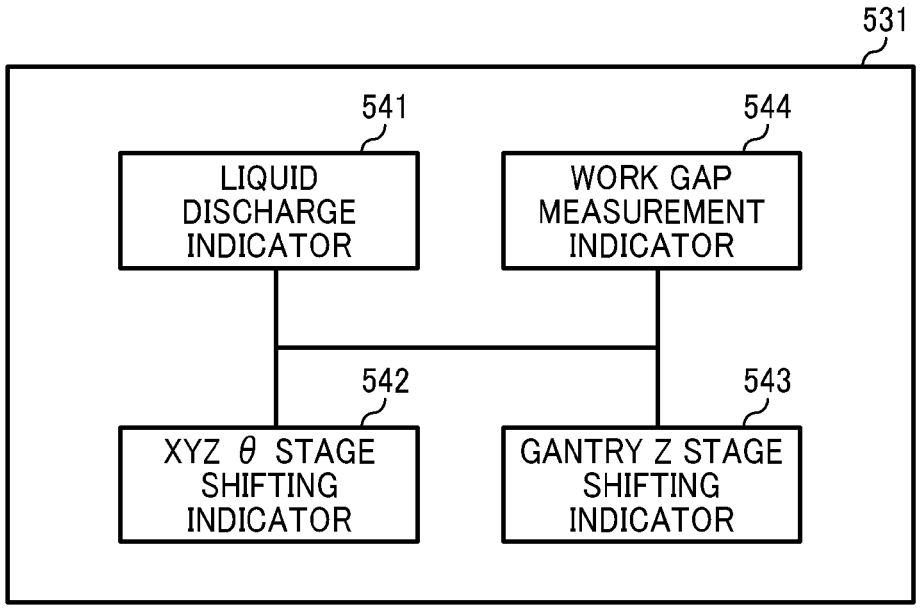
FIG. 17 illustrates an exemplary functional block diagram of the inkjet recording apparatus.

FIG. 17 illustrates exemplary functions realized by the CPU 531. The functions realized by the CPU 531 is a function including a liquid discharge indicator 541, an XYZ θ stage shifting indicator 542, a gantry Z stage shifting indicator 543, and a work gap measurement indicator 544.

The liquid discharge indicator 541 indicates, to the inkjet head unit 506, data related to the liquid discharge such as a timing to discharge liquid droplet and liquid droplet discharge amount.

The XYZ θ stage shifting indicator 542 controls shifting of the XYZ θ stage 502 relative to each axis direction. The gantry Z stage shifting indicator 543 controls shifting of the gantry Z stage 505 relative to the Z-axis direction.

The work gap measurement indicator 544 controls operation related to the measurement of the work gap in each of the work gap measuring units 507A, 507B, 507C, and 507D. The functions performed by the CPU 531 can be performed by the controller apparatus 6.

Figure 18:
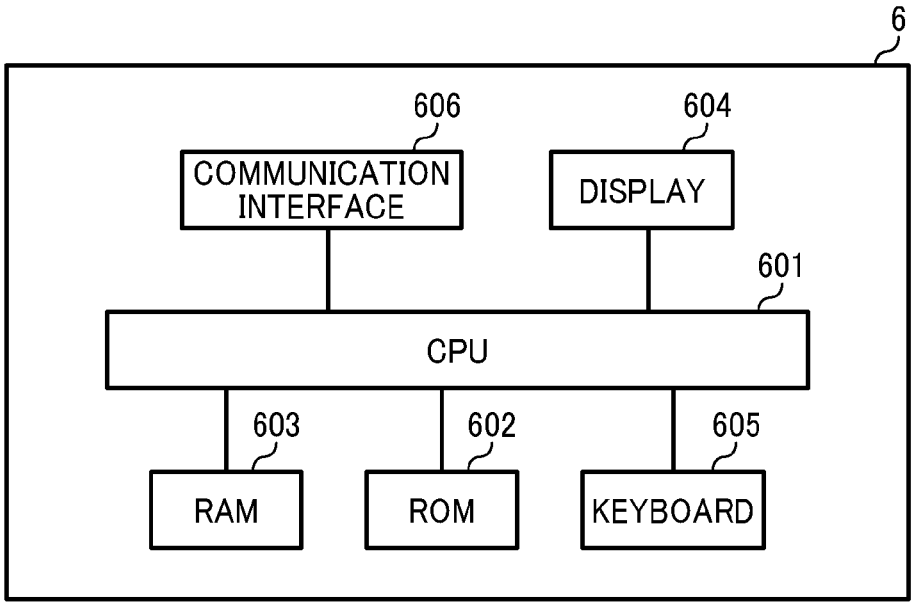
FIG. 18 is an exemplary block diagram illustrating a hardware structure of the controller apparatus.

Next, a description will be given of the hardware construction of the controller apparatus 6. FIG. 18 is a block diagram illustrating a hardware structure of the controller apparatus 6.

The controller apparatus 6 includes a CPU 601, a ROM 602, a RAM 603, a display 604, a keyboard 605, and a communication interface 606.

The CPU 601 performs a program stored in the ROM 602. The ROM 602 is a read-only memory for storing a program or data. The ROM 532 previously stores a program that the CPU 531 executes calculation function and control function, and related data for the CPU 531 to execute calculation and controlling.

The RAM 603 is a writable and readable memory used for decompression of the program and data. The RAM 603 is backed up by a power source such as a battery cell, sequentially stores the data input and output via the CPU 601, and stores the data after the main power to the inkjet recording apparatus 5 is turned off.

The display 604 displays data transmitted from the inkjet recording apparatus 5. In addition, the display 604 is connected to an I/F of the display 604 via a cable. The cable may be for an analog RGB (VGA) signal, and for a component video. Further, the cable may be a high definition multimedia interface (HDMI)® cable or may be a digital visual interface (DVI) cable.

The keyboard 605 receives various inputs from users. The user operates the keyboard 605 and selects a control method of the inkjet recording apparatus 5 based on the data displayed on the display 604. The keyboard 605 may be of any format as far as it can receive inputs from the user. For example, a configuration of the display 604 and the keyboard 605 may be an integrated type using a touch panel display.

The communication interface 606 is an interface for communication with the inkjet recording apparatus 5 and communication with the inkjet recording apparatus 5 is enabled via the communication interface 606. The communication interface 606 also communicates with the inkjet recording apparatus 5 via wired or wireless communication.

Next, a function performed by the CPU 601 included in the controller apparatus 6 will be described.

Figure 19:
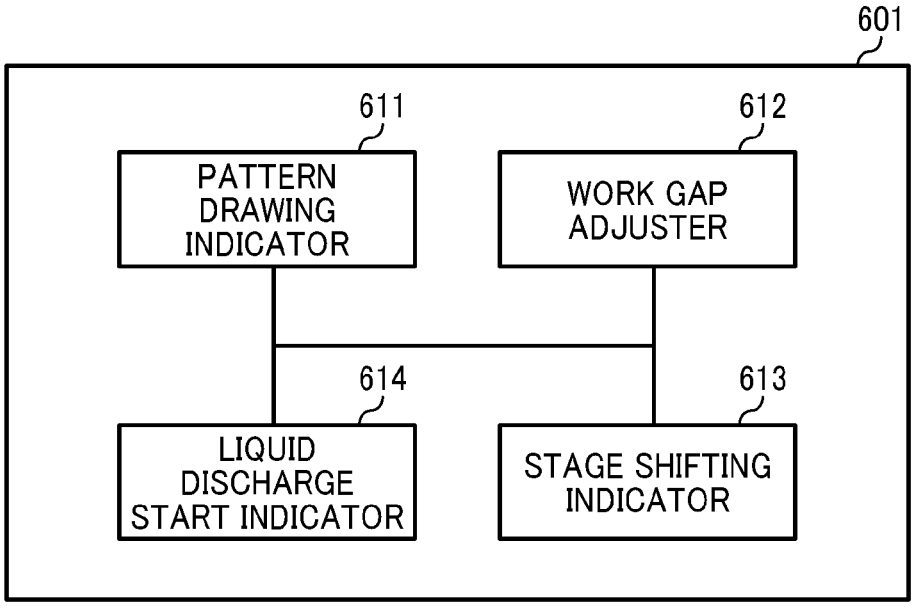
FIG. 19 illustrates an exemplary functional block diagram of the controller apparatus.

FIG. 19 illustrates exemplary functions realized by the CPU 601. The functions realized by the CPU 601 include a pattern drawing indicator 611, a work gap adjuster 612, a stage shifting indicator 613, and a liquid discharge start indicator 614.

The pattern drawing indicator 611, the work gap adjuster 612, the stage shifting indicator 613, and the liquid discharge start indicator 614 are performed by the CPU 601 using a program written in the ROM 602 or the RAM 603.

The pattern drawing indicator 611 indicates a discharging process of the liquid droplet from the inkjet head unit 506 and a shifting operation of the XYZ θ stage 502 in each of the axis directions. The pattern drawing indicator 611 indicates a discharging process of the liquid droplet from the inkjet head unit 506 and a shifting operation of the XYZ θ stage 502 in X-, and Y-axis directions, to perform drawing of predetermined patterns to the discharging target.

The work gap adjuster 612 adjusts the work gap based on the work gaps LA, LB, Lc, and LD transmitted from the work gap measuring unit 507.

The stage shifting indicator 613 indicates a shifting operation of the XYZ θ stage 502 based on the data from the pattern drawing indicator 611. The stage shifting indicator 613 indicates shifting to each axis direction to the XYZ θ stage 502. Shifting indication includes each axis coordinate to shift the XYZ θ stage 502 relative to each axis direction. The stage shifting indicator 613 includes a function to calculate the coordinate of the XYZ θ stage 502. For example, the stage shifting indicator 613 calculates the Z-axis coordinate to shift the XYZ θ stage 502 relative to the Z-axis direction.

The liquid discharge start indicator 614 indicates information related to the liquid droplet discharge such as a timing to discharge a liquid droplet and an amount of the liquid droplet to be discharged, to the inkjet head unit 506 based on the data from the pattern drawing indicator 611.

Each function performed by the pattern drawing indicator 611, the work gap adjuster 612, the stage shifting indicator 613, and the liquid discharge start indicator 614 can be divided and shared, and can be complemented by each device. The functions performed by the CPU 601 can be performed by the inkjet recording apparatus 5.

According to the inkjet recording apparatus 5 and the inkjet recording system 7, positional precision of the liquid droplet impacted on the discharging target can be improved.

Next, nozzle plates according to examples 1 and 2, and a comparative example 1 will be described.

The second electrode 106 for neutralization is formed on the nozzle face 101 of the nozzle plate 1 and the second electrode 106 is electrically grounded, thereby forming a nozzle plate prototype 1 (which is the example 1). The nozzle plate similarly formed as in the example 1 except that the second electrode 106 is not provided, is set as a nozzle plate prototype 2 (which is the comparative example 1). In addition, the second electrode 106 for neutralization is formed and the second electrode 106 is not electrically grounded, which is set as a nozzle plate prototype 3 (corresponding to the example 2).

Each nozzle plate 1 is used and the laminated plate 3 is formed via the above producing method. Au organic compound ink (produced by Daiken Chemical Co., Ltd.) is injected to each of the produced laminated plate 3 from the ink injection port 201, and the laminated plate 3 is mounted on the inkjet head 4. Further, a glass substrate (with a product name of OA-10G, produced by Nippon Electric Glass Co., Ltd.) as the print object 108 is placed on the stage 109.

Voltage is applied to the nozzle plate prototypes 1, 2 and 3 from the high voltage pulse amplifier 107 to electrically charge the ink and the ink droplet is discharged. Square wave is used as an input pulse and the frequencies are variously changed among 6 kHz, 5 kHz, 4 kHz, 3 kHz, 2 kHz, 1 kHz, 500 Hz, 200 Hz, 100 Hz, 50 Hz, and 10 Hz.

Figure 20:
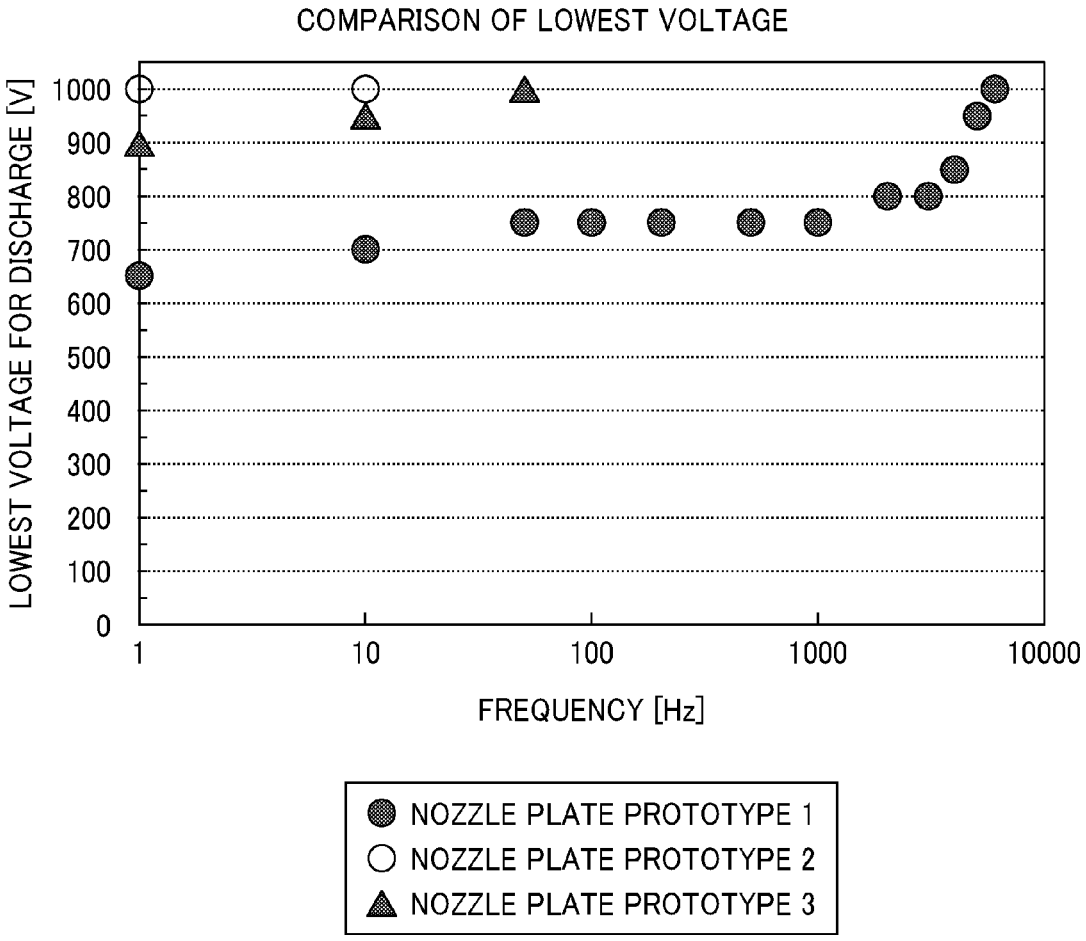
FIG. 20 is a graph to show comparison results of lowest voltages for discharge by nozzle plates 1, 2 and 3.

The lowest voltage for discharge [V] dischargeable of ink was measured for each of the nozzle plate prototypes 1, 2 and 3. FIG. 20 is a graph showing comparison results of the lowest voltage for discharge by each of the nozzle plate prototypes 1, 2 and 3.

The nozzle plate prototype 2 according to the comparative example 1 requires the lowest voltage of 1,000 volts of applied voltage at frequencies of 10 Hz and 1 Hz. The ink discharge was not observed at an applied voltage of 1,000 volts in the frequency area more than 10 Hz.

On the other hand, the nozzle plate prototype 1 according to the example 1 requires the lowest voltages of 700 volts and 650 volts, at frequencies of 10 Hz and 1 Hz, respectively. It is confirmed that the lowest voltage for discharge is lowered by providing the second electrode 106 grounded at the nozzle face 101.

It was further confirmed that the nozzle plate prototype 1 was capable of discharging ink even by inputting a higher frequency pulse. The results were as follows: 1,000 volts at a frequency 6 kHz, 950 volts at 5 kHz, 850 volts at 4 kHz, 800 volts at 3 kHz, 800 volts at 2 kHz, 750 volts at 1 kHz, 750 volts at 500 Hz, 750 volts at 200 Hz, 750 volts at 100 Hz, 750 volts at 50 Hz, 700 volts at 10 Hz, and 650 volts at 1 Hz.

Due to the nozzle plate prototype 1 according to the example 1, and due to effects by the second electrode 106 grounded at the nozzle face 101, the ink discharge was enabled without any discharging failure. It is also possible to further reduce the lowest voltage for discharging by selecting an optimal nozzle shape.

The nozzle plate prototype 3 according to the example 2 requires the lowest voltages of 1,000 volts, 950 volts, and 900 volts at frequencies of 50 Hz, 10 Hz, and 1 Hz, respectively. It was confirmed that the lowest voltage for discharge was lowered as to the comparative example 1; however, the second electrode 106 should be grounded.

The present invention is not limited to the above preferred embodiments, and various modifications can be applied without distorting from the concept of the present invention.

Additional modifications and variations of the present invention are possible in light of the above teachings. It is therefore to be understood that, within the scope of the appended claims, the invention may be practiced other than as specifically described herein.

What is claimed is:

1. A nozzle plate for a liquid droplet discharge head to discharge a charged liquid droplet, the nozzle plate comprising:

a discharge port disposed on a nozzle face;

a discharge chamber filled with liquid to be discharged from the discharge port;

a nozzle hole extending from the discharge port in a thickness direction of the nozzle plate and communicating with the discharge chamber;

a first electrode disposed at either the discharge chamber or the nozzle hole and contacting part of the liquid droplet; and a second electrode disposed on the nozzle face and neither connecting to the first electrode nor contacting the liquid droplet.

2. The nozzle plate according to claim 1, wherein the second electrode is electrically grounded.

3. The nozzle plate according to claim 1, wherein the second electrode is disposed on the nozzle face at an area not electrically connected to the liquid droplet.

4. The nozzle plate according to claim 1, wherein the second electrode is disposed on at least a part of the nozzle face other than the discharge port and a peripheral portion of the discharge port.

5. The nozzle plate according to claim 1, further comprising a projection disposed at a peripheral portion of the discharge port and protruding from the nozzle face, wherein the second electrode is disposed on at least a part of the projection.

6. The nozzle plate according to claim 1, wherein the first electrode is connected to a voltage applying device to apply voltage to the first electrode.

7. A liquid droplet discharge head comprising:

the nozzle plate according to claim 1; and a channel, connecting to the nozzle plate, through which the liquid droplet is supplied.

8. A liquid droplet discharge apparatus to discharge a liquid droplet to a discharging target, comprising:

the liquid droplet discharge head according to claim 7;

a voltage applying device connecting to the first electrode;

a stage to support the discharging target; and a shifting device to shift the liquid droplet discharge head and the stage relative to each other.

9. The liquid droplet discharge apparatus according to claim 8, further comprising a wire for the second electrode, wherein the wire from the second electrode is electrically grounded via the liquid droplet discharge head and the liquid droplet discharge apparatus.

10. A nozzle plate for a liquid droplet discharge head to discharge a charged liquid droplet, the nozzle plate comprising:

a discharge port disposed on a nozzle face;

a nozzle hole extending from the discharge port in a thickness direction of the nozzle plate;

a first electrode disposed at the nozzle hole and contacting part of the liquid droplet; and a second electrode disposed on the nozzle face and neither connecting to the first electrode nor contacting the liquid droplet discharged from the liquid discharge port.

11. The nozzle plate according to claim 10, wherein the second electrode is electrically grounded.

12. The nozzle plate according to claim 10, wherein the second electrode is disposed on the nozzle face at an area not electrically connected to the liquid droplet.

13. The nozzle plate according to claim 10, wherein the second electrode is disposed on at least a part of the nozzle face other than the discharge port and a peripheral portion of the discharge port.

14. The nozzle plate according to claim 10, further comprising a projection disposed at a peripheral portion of the discharge port and protruding from the nozzle face, wherein the second electrode is disposed on at least a part of the projection.

15. The nozzle plate according to claim 10, wherein the first electrode is connected to a voltage applying device to apply voltage to the first electrode.

16. A liquid droplet discharge head comprising:

the nozzle plate according to claim 10; and a channel, connecting to the nozzle plate, through which the liquid droplet is supplied.

17. A liquid droplet discharge apparatus to discharge a liquid droplet to a discharging target, comprising:

the liquid droplet discharge head according to claim 16;

a voltage applying device connecting to the first electrode;

a stage to support the discharging target; and a shifting device to shift the liquid droplet discharge head and the stage relative to each other.

18. The liquid droplet discharge apparatus according to claim 17, further comprising a wire for the second electrode, wherein the wire from the second electrode is electrically grounded via the liquid droplet discharge head and the liquid droplet discharge apparatus.

* * * * *